US010149594B2

(12) United States Patent
Jung et al.

(10) Patent No.: US 10,149,594 B2
(45) Date of Patent: Dec. 11, 2018

(54) DISHWASHER AND METHOD FOR CONTROLLING SAME

(71) Applicant: SAMSUNG ELECTRONICS CO., LTD., Suwon-si, Gyeonggi-do (KR)

(72) Inventors: Min Ho Jung, Suwon-si (KR); Mi Ra Kim, Suwon-si (KR); Sung Jin Kim, Suwon-si (KR); Hyoung Jun Kim, Uiwang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/108,900

(22) PCT Filed: Dec. 24, 2014

(86) PCT No.: PCT/KR2014/012822
§ 371 (c)(1),
(2) Date: Jun. 29, 2016

(87) PCT Pub. No.: WO2015/102299
PCT Pub. Date: Jul. 9, 2015

(65) Prior Publication Data

US 2016/0324397 A1 Nov. 10, 2016

(30) Foreign Application Priority Data

Dec. 31, 2013 (KR) ..... 10-2013-0169292

(51) Int. Cl.
*A47L 15/42* (2006.01)
*A47L 15/16* (2006.01)

(52) U.S. Cl.
CPC ..... *A47L 15/4282* (2013.01); *A47L 15/16* (2013.01); *A47L 2301/04* (2013.01); *A47L 2501/20* (2013.01)

(58) Field of Classification Search
CPC .. A47L 15/4221; A47L 15/4282; A47L 15/16; A47L 15/18
See application file for complete search history.

(56) References Cited

U.S. PATENT DOCUMENTS 2,236,791 A 4/1941 Forsberg
4,664,429 A * 5/1987 Notaro ..... D06F 37/42 292/201

(Continued)

FOREIGN PATENT DOCUMENTS

CN 1552271 12/2004
CN 101095608 1/2008

(Continued)

OTHER PUBLICATIONS

Form PCT/ISA/237; Written Opinion of the International Searching Authority dated Mar. 31, 2015 in corresponding International Patent Application No. PCT/KR2014/012822 (10 pages) (16 pages English Translation).

(Continued)

*Primary Examiner* — Michael E Barr
*Assistant Examiner* — Benjamin L Osterhout
(74) *Attorney, Agent, or Firm* — Staas & Halsey LLP

(57) ABSTRACT

The present invention relates to a dishwasher and a method for controlling same, and the dishwasher may comprise a wash tub having an opening on at least one side thereof; a spray nozzle, provided in the interior of the wash tub, for spraying wash water; a reflecting module capable of moving in the interior of the wash tub, and reflecting the wash water sprayed by the spray nozzle; and a moving module, to which the reflecting module is detachably attached, for moving same in at least one direction.

20 Claims, 39 Drawing Sheets

(56) References Cited

U.S. PATENT DOCUMENTS

| | | | |
|---|---|---|---|
| 2005/0150529 | A1 | 7/2005 | Vanderroest et al. |
| 2009/0056754 | A1 | 3/2009 | Rolek |
| 2009/0071508 | A1 | 3/2009 | Sundaram et al. |
| 2012/0031432 | A1 | 2/2012 | Beaudet et al. |
| 2013/0319487 | A1 | 12/2013 | Hong et al. |

FOREIGN PATENT DOCUMENTS

| | | | |
|---|---|---|---|
| CN | 103462574 | | 12/2013 |
| EP | 1488730 | | 12/2004 |
| EP | 2 671 494 | | 12/2013 |
| EP | 2 807 970 | | 12/2014 |
| JP | 2008036130 | A | 2/2008 |
| KR | 10-2013-0081115 | | 7/2013 |
| WO | 92/12665 | | 8/1992 |
| WO | WO 2015/102299 | A1 | 7/2015 |

OTHER PUBLICATIONS

Form PCT/ISA/210; International Search Report dated Mar. 31, 2015 in corresponding International Patent Application No. PCT/KR2014/012822 (3 pages) (2 pages English Translation).
Extended European Search Report dated Jul. 26, 2017 in corresponding European Patent Application No. 14876302.2, 7 pages.
European Communication under Rule 71(3) dated Jul. 5, 2018 in European Patent Application No. 14876302.2.
Chinese Office Action dated Jun. 5, 2018 in Chinese Patent Application No. 201480073649.4.

* cited by examiner

DISHWASHER AND METHOD FOR CONTROLLING SAME

CROSS-REFERENCE TO RELATED APPLICATIONS

This application is a U.S. national stage application of PCT international application PCT/KR2014/012822, filed on Dec. 24, 2014 and claims the benefits of Korean Patent Application No. 10-2013-0169292, filed on Dec. 31, 2013, respectively, the contents are incorporated herein by reference.

BACKGROUND

1. Technical Field

The present disclosure relates to a dishwasher and a method for controlling the same.

2. Background Art

A dishwasher is a type of a home appliance for washing dishes by spraying wash water having high pressure onto dishes stored in a basket in a wash tub to remove foreign substances and the like remaining on the dishes. The dishwasher may include a main body having a wash tub provided inside it for washing dishes, a basket that stores dishes, a sump that retains wash water, a spray nozzle that sprays the wash water, and a pump that supplies the wash water in the sump to the spray nozzle.

A spray structure that sprays wash water using a rotating spray nozzle may be provided in the dishwasher. The rotating spray nozzle may allow dishes to be washed by spraying the wash water onto dishes within a range of a radius of rotation while rotating by a water pressure. In addition, a spray structure that sprays wash water using a fixed nozzle fixed at one side of the wash tub may be provided in the dishwasher. The fixed nozzle may spray the wash water onto the dishes in a predetermined direction to allow the dishes to be washed.

SUMMARY

It is an aspect to provide a dishwasher whose inner portion can be easily cleaned by a user and a method for controlling the same.

To achieve the aspect mentioned above, a dishwasher and a method for controlling the same are provided.

A dishwasher includes a wash tub having an opening on at least one side thereof; a spray nozzle provided inside the wash tub for spraying wash water; a reflecting module that is movable inside the wash tub and reflects the wash water sprayed by the spray nozzle; and a moving module to which the reflecting module is detachably coupled for moving the reflecting module in at least one direction.

The moving module may include at least one rail, and a moving body that moves along the at least one rail and to which the reflecting module is detachably coupled.

In this case, the dishwasher may further include a fastening member that couples the reflecting module to the moving body.

Here, the fastening member may include a pin or a bolt, and the pin or the bolt may be inserted into or detached from a coupling groove formed at each of the reflecting module and the moving body.

In addition, the fastening member may include a first coupling member provided at the reflecting module and a second coupling member provided at the moving body and coupled to the first coupling member.

The dishwasher may further include a motor that generates a driving force and a belt that rotates by being connected to a drive pulley and an idle pulley to transmit the driving force of the motor to the moving module.

The dishwasher may further include a control unit that determines at least one control mode among a plurality of control modes for controlling the dishwasher and controls the moving module so that the reflecting module moves in a direction in which the opening is installed when the determined control mode is a cleaning mode.

The control unit may stop the reflecting module when the reflecting module is near the opening.

The control unit may also control a door provided at the opening to be openable and closable when the reflecting module is stopped.

In addition, the control unit may control the reflecting module to be detachable from the moving module when the reflecting module is stopped.

Here, the plurality of control modes may include a dish washing mode, an operation standby mode, and the cleaning mode.

The control unit may control the reflecting module to move toward the spray nozzle when the determined control mode is the operation standby mode.

The control unit may control the spray nozzle to spray the wash water and the reflecting module to move inside the wash tub when the determined control mode is the dish washing mode.

The spray nozzle may be provided in a direction in which the opening is installed in the wash tub or may be provided in an opposite direction opposite from the direction in which the opening is installed in the wash tub.

The dishwasher may further include a main body with the wash tub built-therein.

In addition, the dishwasher may further include an input unit that is provided outside the main body and receives at least one selected command among a plurality of modes.

A method for controlling a dishwasher may control a dishwasher that includes a wash tub in which and an openable and closable opening is installed and a reflecting module that is provided inside the wash tub and is movable in at least one direction and is controlled according to at least one control mode among a plurality of control modes.

The method for controlling the dishwasher includes determining the at least one control mode among the plurality of control modes, moving the reflecting module in a direction in which the opening of the wash tub is installed when the determined control mode is a cleaning mode, and stopping the reflecting module by the control unit when the reflecting module is near the opening.

The method for controlling the dishwasher may further include controlling a door provided at the opening to be openable and closable when the reflecting module is stopped.

The method for controlling the dishwasher may further include detaching the reflecting module from a moving module. In this case, the moving module may have the reflecting module detachably coupled thereto and may move the reflecting module in at least one direction.

The plurality of control modes may include a dish washing mode, an operation standby mode, and a cleaning mode.

The method for controlling the dishwasher may further include reflecting wash water sprayed by the spray nozzle spraying the wash water by the reflecting module while the reflecting module moves when the determined control modes is the dish washing mode. In this case, the spray nozzle may be provided inside the wash tub and spray the wash water onto the reflecting module.

The method for controlling the dishwasher may further include moving the reflecting module toward a spray nozzle when the determined control mode is an operation standby mode.

A moving module may include at least one rail and a moving body that moves along the at least one rail and to which the reflecting module is detachably coupled.

According to a dishwasher and a method for controlling the same described above, a user can easily clean the inside of the dishwasher.

Particularly, according to the dishwasher and the method for controlling the same described above, the user can easily clean a reflecting module inside the dishwasher such that foreign substances and the like existing on the reflecting module can easily be removed.

Accordingly, dishes can be prevented from being contaminated by foreign substances and the like existing on the reflecting module when the dishwasher washes dishes, and, in addition, since a change of wash water reflecting direction due to foreign substances and the like can prevented, an effect of reconsidering efficiency of washing dishes dish washing can also be obtained.

DESCRIPTION OF EMBODIMENTS

Figure 1:
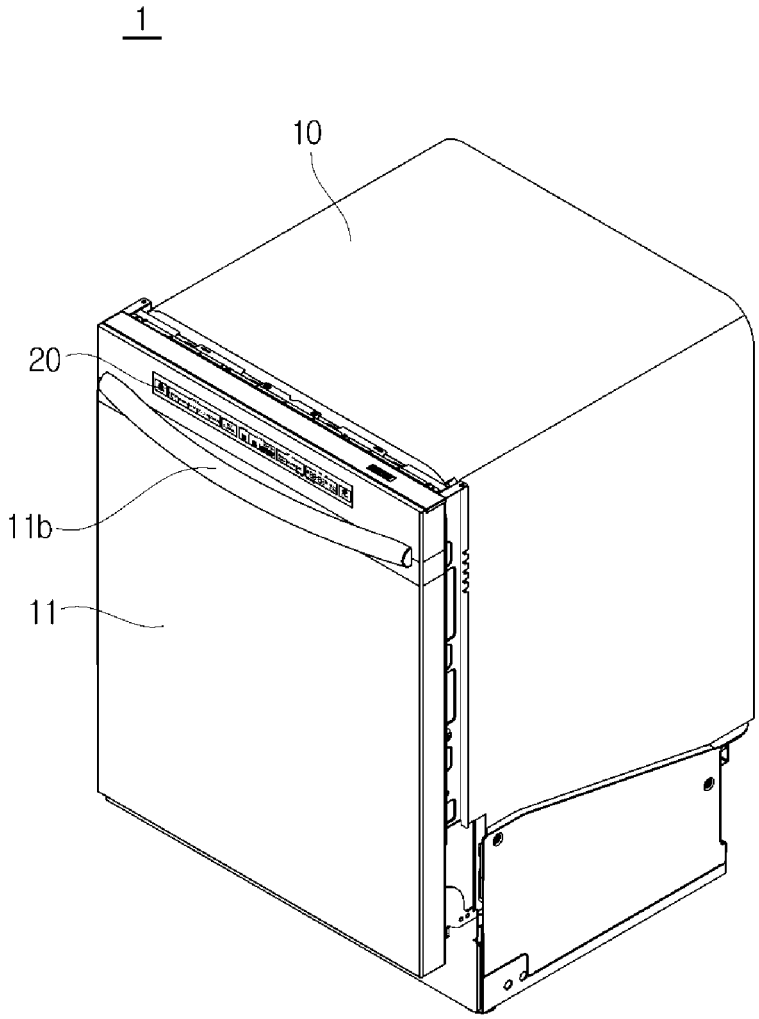
FIG. 1 is a perspective view of an embodiment of a dishwasher.
Figure 2:
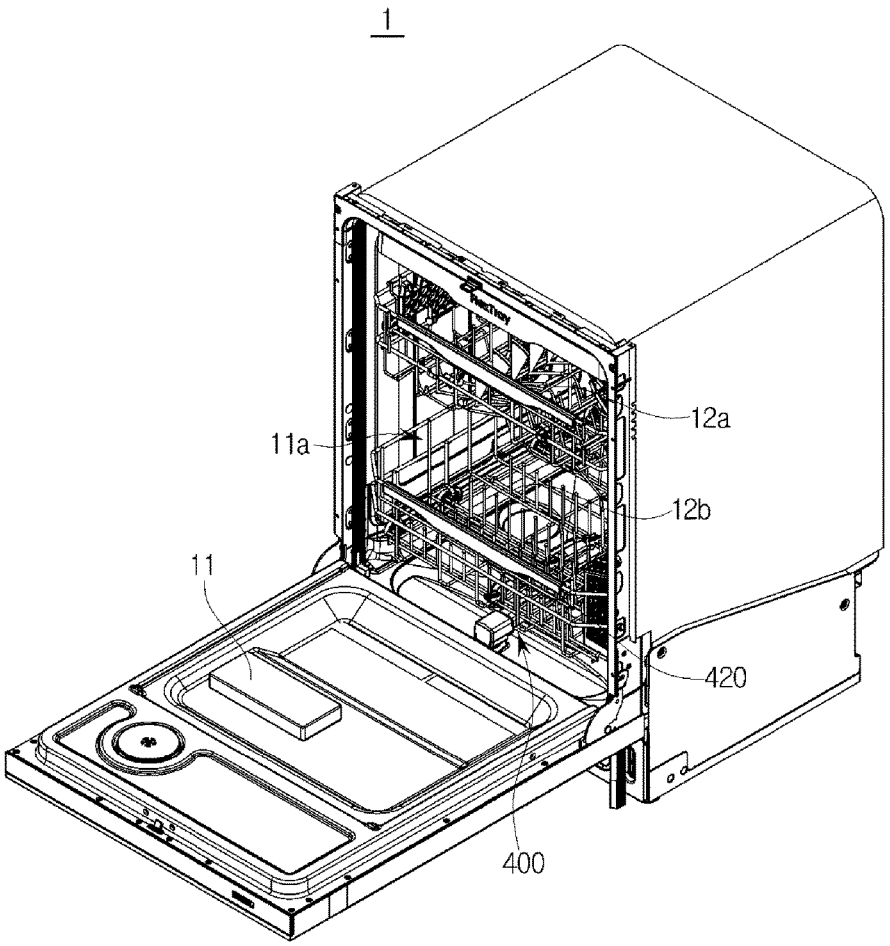
FIG. 2 is a perspective view illustrating a state in which a door of the dishwasher is open.
Figure 3:
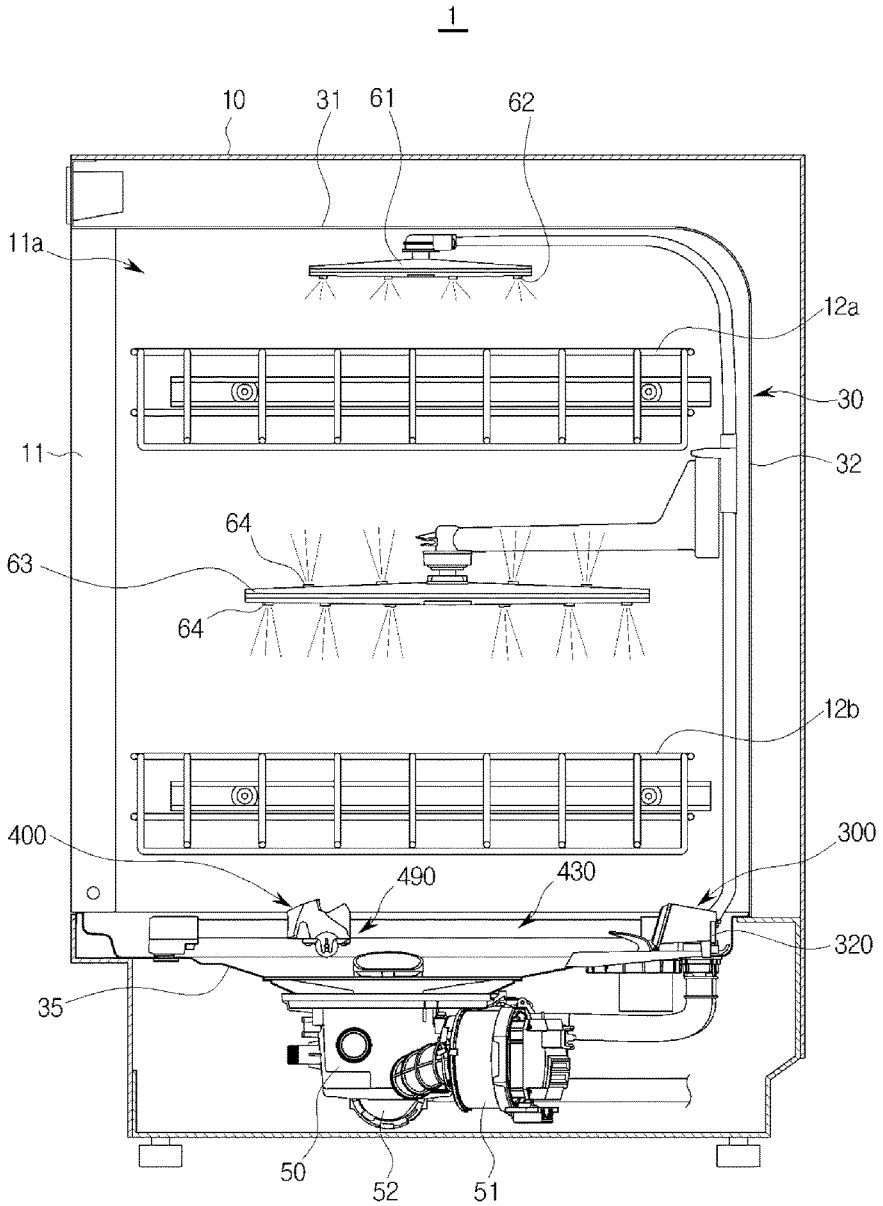
FIG. 3 is a schematic cross-sectional view of the embodiment of the dishwasher.

Hereinafter, an overall structure of an embodiment of a dishwasher 1 will be generally described with reference to FIGS. 1 to 3. FIG. 1 is a perspective view of an embodiment of a dishwasher, FIG. 2 is a perspective view illustrating a state in which a door of the dishwasher is open, and FIG. 3 is a schematic cross-sectional view of the embodiment of the dishwasher.

Referring to what is illustrated in FIG. 1, the dishwasher 1 may include a main body 10 that forms an exterior and has a wash tub 30 provided therein. The main body 10 may be in the shape of a box as illustrated in FIG. 1. However, the shape of the main body 10 is not limited to that illustrated in FIG. 1, and may also be formed in the shape of a cylinder or a polygonal column, or may also be formed in the shape of a polygonal box besides a hexahedron. Other than above, the dishwasher 1 may be formed in various shapes that may be applied as an outer shape.

A user interface may be installed at an outer surface of the main body 10. A user interface 20 may include an input unit that receives a predetermined instruction from a user. An input unit 20*a* may include at least one of a keyboard, a mouse, a track-ball, a touch screen, a touch pad, a paddle, various types of levers or handles, a joystick, and other various input means. According to an embodiment, the input unit 20*a* may also be installed at an external device connected to the dishwasher 1. The external device may include a personal computer (PC), a smartphone, a tablet PC, a personal digital assistant (PDA), a cellular phone, a remote controller, etc. The user interface 20 may include a display unit 20*b* for displaying various types of information to the user. The display unit 20*b* may include a display means using a plasma display panel (PDP), a light emitting diode (LED), an organic light emitting diode (OLED), a liquid crystal display (LCD), or the like. The display unit 20*b* may also express a three-dimensional image.

A door 11 through which dishes may be inserted and withdrawn may be provided at a side of the main body 10. The door 11 may be opened and closed by being moved in a predetermined direction as illustrated in FIG. 2. According to an embodiment, a hinge that rotates a body of the door 11 in a predetermined direction may be provided at one end of the door 11. According to an embodiment, the door 11 may also be opened and closed by a sliding means. The door 11 may be provided in front of an opening 11*a* of a wash tub 30, and the user may store dishes in the wash tub 30 through the open door 11 and the opening 11*a*. A handle 11*b* may be provided at the door 11 so that the user can easily open and close the door 11. According to an embodiment, the user interface 20 such as the input unit 20*a* or the display unit 20*b* may also be installed at the door 11. The user interface 20 may also be installed near the handle 11*b*.

Referring to what is illustrated in FIGS. 2 and 3, the wash tub 30 in which dishes are washed may be provided inside the main body 10. The wash tub 30 may be formed in a shape corresponding to the outer shape of the main body 10. For example, the wash tub 30 may be formed in the shape of a box. Although an embodiment in which the wash tub 30 is formed in the shape of a hexahedral box is illustrated in FIG. 3, the shape of the wash tub 30 is not limited thereto. The wash tub 30 may also be formed in the shape of a cylinder or a polygonal column, or may also be formed in the shape of a polygonal box besides a hexahedron. In addition, the wash tub 30 does not always have to be formed in a shape corresponding to the outer shape of the main body 10.

The opening 11*a* through which dishes may be inserted and withdrawn in at least one direction may be provided at one surface of the wash tub 30. The opening 11*a* may be opened and closed by the door 11 as illustrated in FIGS. 2 and 3. The wash tub 30 may include a plurality of walls 31 to 34 and a bottom plate 35. Hereinafter, while describing the wash tub 30, a direction and an area in which the bottom plate 35 is disposed will be referred to as a lower direction or a lower portion, and a direction opposite the direction in which the bottom plate 35 is disposed will be referred to as an upper direction or an upper portion. A direction in which the opening 11*a* is disposed will be referred as the front, and a direction opposite the direction in which the opening 11*a* is disposed will be referred to as the rear. In addition, a wall disposed at the opposite side of the opening 11*a* will be referred to as a rear wall 32, a wall disposed at the left when viewed from the opening 11*a* will be referred to as a left wall 33, and a wall disposed at the right when viewed from the opening 11*a* will be referred to as a right wall 34. Furthermore, a wall disposed at the opposite side of the bottom plate 35 of the wash tub 30 will be referred to as an upper wall 31.

Dish accommodation units 12*a* and 12*b* in which dishes are mounted, a nozzle assembly 300 that sprays wash water toward the dish accommodation units 12*a* and 12*b* or a reflecting module 400, the reflecting module 400 that reflects the wash water sprayed from spray nozzles 311, 313, and 320 of the nozzle assembly 300 toward the dishes while moving inside the wash tub 30, and a moving module 420 that moves the reflecting module 400 may be installed inside the wash tub 30.

The dish accommodation units 12*a* and 12*b* may be in the shape of a basket in which pins and the like are formed. The basket may be a wire rack formed of a wire so that the wash water can pass therethrough without pooling. The dish accommodation units 12*a* and 12*b* may be detached from the wash tub 30. The dish accommodation units 12*a* and 12*b* may also be withdrawn outside of the opening 11*a* using a rail and a roller (not shown), etc. provided at the left wall 33 and the right wall 34 inside the wash tub 30. The withdrawal of the dish accommodation units 12*a* and 12*b* may be performed manually or automatically. The dish accommodation units 12*a* and 12*b* may include an upper dish accommodation unit 12*a* disposed at an upper portion of the wash tub 30 and a lower dish accommodation unit 12*b* disposed at a lower portion of the wash tub 30.

Figure 4:
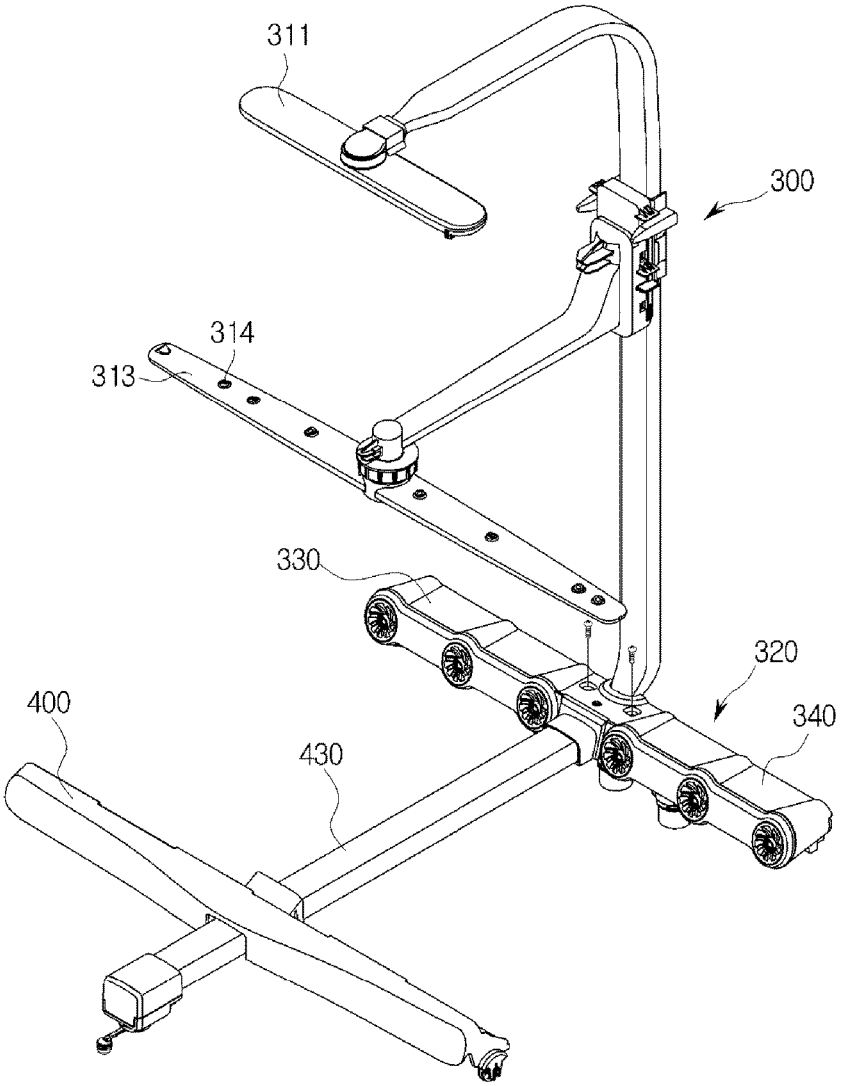
FIG. 4 is view illustrating an embodiment of a nozzle assembly.

FIG. 4 is a view illustrating an embodiment of a nozzle assembly. Referring to what is illustrated in FIG. 4, the nozzle assembly 300 may include an upper rotary nozzle assembly 311 provided at the upper portion of the wash tub 30, a middle rotary nozzle assembly 313 provided at a central portion of the wash tub 30, and a fixed nozzle assembly 320 provided at the lower portion of the wash tub 30. Each of the nozzle assemblies 311, 313, 330, and 340 may spray wash water with high pressure to wash dishes.

The upper rotary nozzle assembly 311 may be provided above the upper dish accommodation unit 12*a* and spray the wash water toward the upper dish accommodation unit 12*a* while rotating by a water pressure. A spray hole 312 through which wash water is sprayed may be provided at a lower end of the upper rotary nozzle assembly 311 as illustrated in FIG. 2. The upper rotary nozzle assembly 311 may directly spray wash water toward the dishes stored in the upper dish accommodation unit 12*a*.

The middle rotary nozzle assembly 313 may be disposed between the upper dish accommodation unit 12*a* and the lower dish accommodation unit 12*b*. The middle rotary nozzle assembly 313 may spray the wash water in upper and lower directions while rotating by the water pressure like the upper rotary nozzle assembly 311. A rotational direction of the middle rotary nozzle assembly 313 may be the same as or different from that of the upper rotary nozzle assembly 311. Spray holes 314 may be provided at an upper end and a lower end of the middle rotary nozzle assembly 313. The wash water may be sprayed onto the dishes accommodated in the upper dish accommodation unit 12*a* and the lower dish accommodation unit 12*b* through the spray holes 314.

Figure 5:
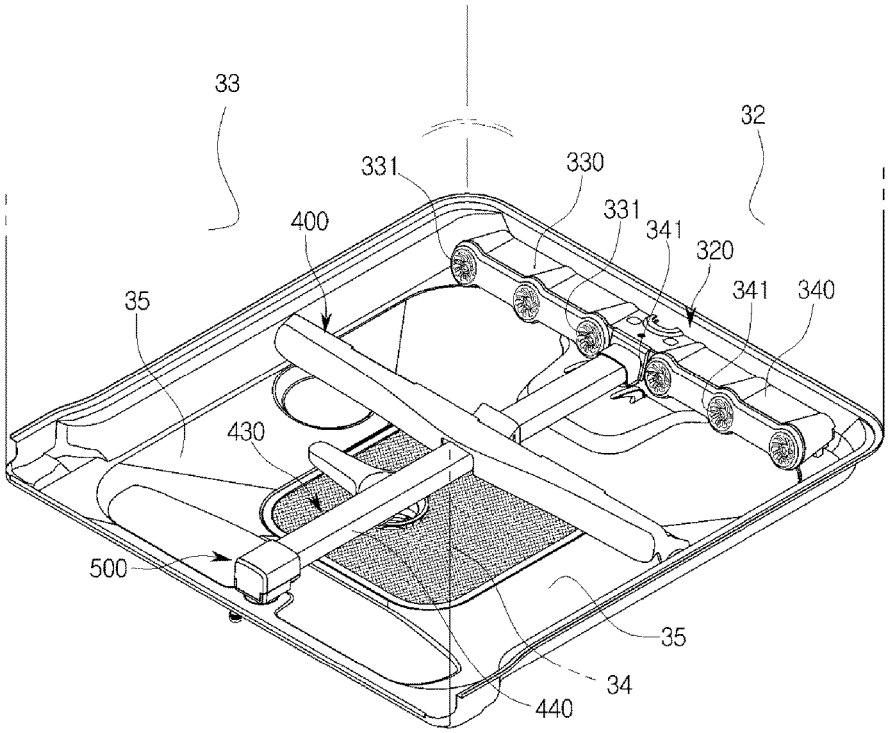
FIG. 5 is a perspective view illustrating an embodiment of a fixed nozzle assembly and a reflecting module.

The fixed nozzle assembly 320 may be fixed at one side of the wash tub 30 as illustrated in FIG. 3. The fixed nozzle assembly 320 may be disposed adjacent to the rear wall 32 of the wash tub 30. FIG. 5 is a perspective view illustrating the embodiment of the fixed nozzle assembly and the reflecting module. As illustrated in FIG. 5, the fixed nozzle assembly 320 may include a left fixed nozzle 330 and a right fixed nozzle 340. A plurality of spray holes 331 and 341 arranged in a horizontal direction may be provided at each of the left fixed nozzle 330 and the right fixed nozzle 340. The spray holes 331 and 341 may spray the wash water toward the front of the wash tub 30. According to an embodiment, the fixed nozzle assembly 320 may spray the wash water independent of the rotary nozzle assemblies 311 and 313. Consequently, the dishwasher 1 may also perform dish washing only with wash water sprayed in a particular direction. In addition, the left fixed nozzle 330 and the right fixed nozzle 340 of the fixed nozzle assembly 320 may also spray wash water independent of each other. Consequently, the dishwasher 1 may be subdivided into particular areas.

The wash water sprayed by the fixed nozzle assembly 320 may be reflected toward the dishes by the reflecting module 400 provided in front of the spray holes 331 and 341. The reflecting module 400 may longitudinally extend in the horizontal direction of the wash tub 30 to be able to reflect the wash water sprayed by the plurality of spray holes 331 and 341 of the fixed nozzle assembly 320 as illustrated in FIG. 5. In other words, one end portion in a longitudinal direction of the reflecting module 400 may be provided to be adjacent to the left wall 33 of the wash tub 30, and the other end portion in the longitudinal direction of the reflecting module 400 may be provided to be adjacent to the right wall 34 of the wash tub 30. The reflecting module 400 may linearly reciprocate along front and rear directions of the wash tub 30. Consequently, the spray structure that includes the fixed nozzle assembly 320 and the reflecting module 400 may wash all areas of the wash tub 30 without a blind spot.

This is differentiated from the case of a rotary nozzle in which wash water can only be sprayed within a boundary of a radius of rotation.

The reflecting module 400 may reflect the wash water sprayed by the fixed nozzle assembly 320 in the upper direction or the lower direction. When the fixed nozzle assembly 320 is disposed below the lower dish accommodation unit 12*b* as illustrated in FIG. 5, the reflecting module 400 may reflect the sprayed wash water in the upper direction to allow the wash water to reach dishes stored in the upper dish accommodation unit 12*a* or dishes stored in the lower dish accommodation unit 12*b*. When the fixed nozzle assembly 320 is disposed between the upper dish accommodation unit 12*a* and the lower dish accommodation unit 12*b*, the reflecting module 400 may reflect the wash water in the upper direction or the lower direction to allow the wash water to be transferred to dishes stored in the upper dish accommodation unit 12*a* or the lower dish accommodation unit 12*b*. When the fixed nozzle assembly 320 is disposed above the upper dish accommodation unit 12*a*, the reflecting module 400 may reflect the wash water in the lower direction to allow the wash water to be transferred to the dishes stored in the upper dish accommodation unit 12*a* or the lower dish accommodation unit 12*b*.

The wash water sprayed by the left fixed nozzle 330 may be reflected only to a left area of the wash tub 30 by the reflecting module 400, and the wash water sprayed by the right fixed nozzle 340 may be reflected only to a right area of the wash tub 30 by the reflecting module 400. In this case, when the left fixed nozzle 330 and the right fixed nozzle 340 of the fixed nozzle assembly 320 spray the wash water independent of each other, a left side and a right side of the dishwasher 1 may be separately washed independent of each other. Of course, washing areas of the dishwasher 1 may be further subdivided and separately washed as necessary.

Figure 6:
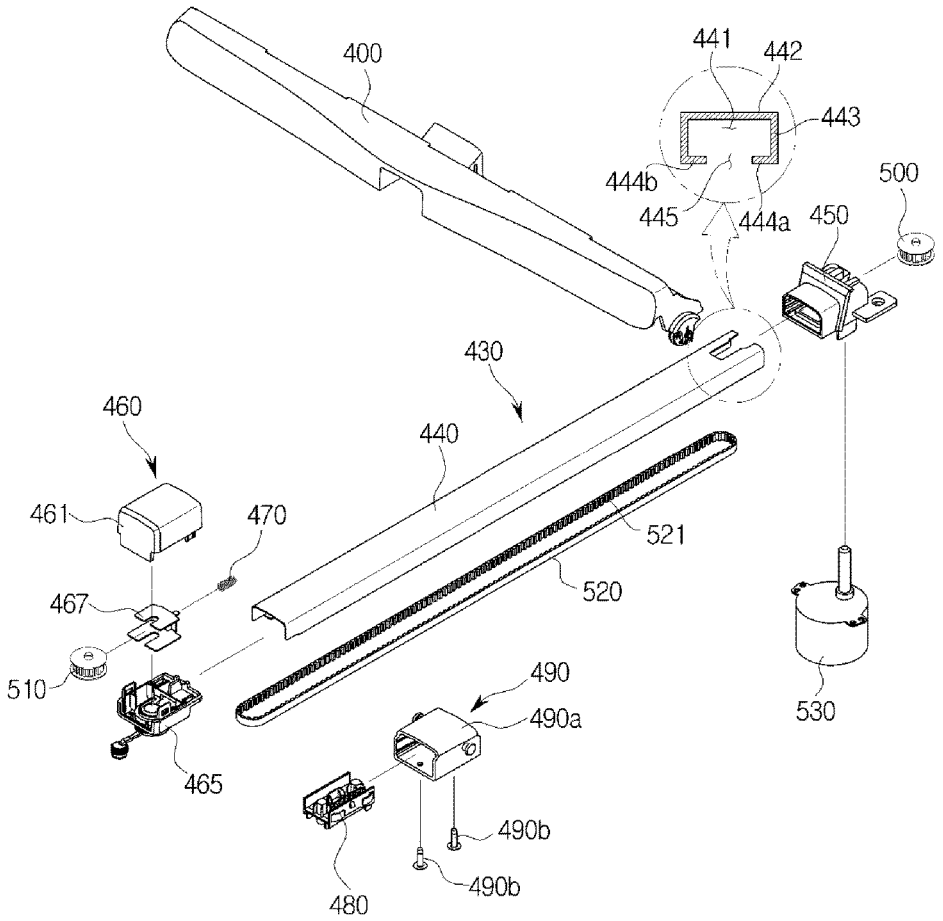
FIG. 6 is an exploded view of an embodiment of the reflecting module and a moving module.

FIG. 6 is an exploded view of an embodiment of the reflecting module and a moving module. The moving module 420 may move the reflecting module 400 in at least one direction. The moving module 420 may include a rail assembly 430, a moving body 490 that moves along a rail 440 of the rail assembly 430, and a motor 530 that generates a driving force for moving the moving body 490.

The rail assembly 430 may include the rail 440 that guides the movement of the reflecting module 400 and has an inner space 441, a drive pulley 500 that rotates by being connected to the motor 530, a belt 520 that rotates by being connected to the drive pulley 500 and is disposed in the inner space 441 of the rail 440, and an idle pulley 510 connected to the belt 520 to rotatably support the belt 520. In addition, the rail assembly 430 may also include a rear holder 450 that rotatably supports the drive pulley 500 and is coupled to a rear end portion of the rail 440, and a front holder 460 that rotatably supports the idle pulley 510 and is coupled to a front end portion of the rail 440.

The rail 440 may be formed with a metal material. The rail 440 may be provided to longitudinally extend in front and rear directions at the center with respect to the left wall 33 and the right wall 34 of the wash tub 30. According to an embodiment, the rail assembly 430 may include one rail 440 as illustrated in FIG. 5 or may also include a plurality of rails. The rail 440 may have a pipe shape in which an opening 445 is formed at a lower portion. For example, as illustrated in FIG. 6, the rail 440 may include the inner space 441, an upper wall 442, a plurality of lower walls 444*a* and 444*b* spaced apart from each other, both side walls 443, and the lower opening 445 formed between the plurality of lower wall 444*a* and 444*b*. The lower opening 445 may be formed to be extended from one end portion to the other end portion in a longitudinal direction of the rail 440. When the rail 440 has the shape above, since the belt 520 may be disposed in the inner space 441 of the rail 440, an operation of the belt 520 being interfered with due to coming into contact with dishes in the wash tub 30 or the belt 520 being corroded due to coming into contact with the wash water in the wash tub 30 may be prevented. In addition, the driving force of the belt 520 may be transmitted to the reflecting module 400 through the opening 445.

The belt 520 may be disposed in the inner space 441 of the rail 440. The belt 520 may form a closed loop by being wound around the drive pulley 500 and the idle pulley 510 and may rotate along a rotational direction of the motor 530 when the motor 530 operates. The belt 520 may be formed of a resin material including aramid fibers. A toothed form 521 that transmits the driving force of the belt 520 to a belt holder 480 may be formed at an inner surface of the belt 520.

Figure 7:
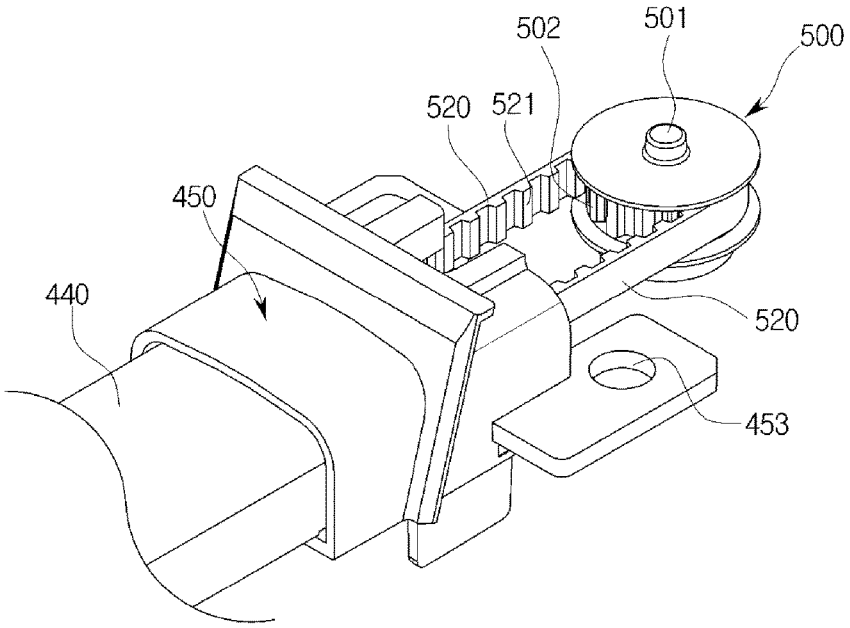
FIG. 7 is a view illustrating an embodiment of a rail, a belt, a drive pulley, and a rear holder of the moving module.
Figure 8:
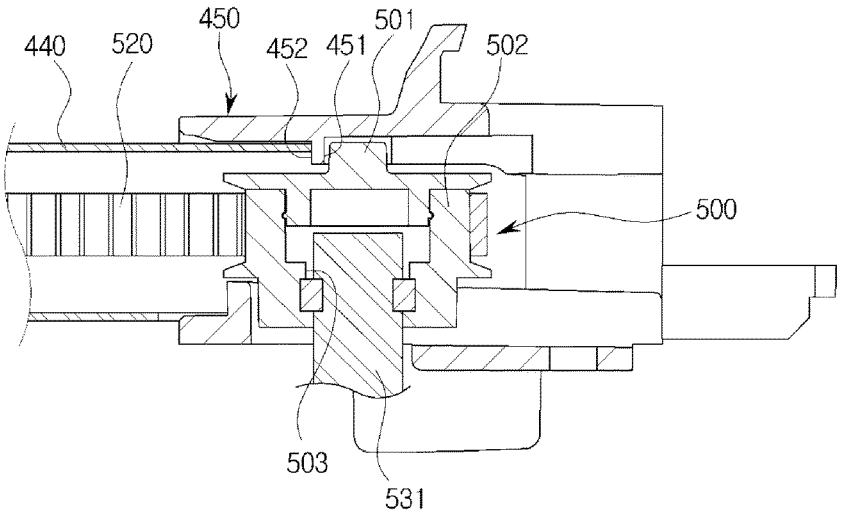
FIG. 8 is a cross-sectional view of the embodiment of the rail, the belt, the drive pulley, and the rear holder of the moving module.

FIG. 7 is a view illustrating an embodiment of a rail, a belt, a drive pulley, and a rear holder of the moving module, and FIG. 8 is a cross-sectional view of the embodiment of the rail, the belt, the drive pulley, and the rear holder of the moving module. According to an embodiment, the drive pulley 500 may include a shaft connection unit 503 that receives a driving force by being connected to a rotary shaft 501 and a drive shaft 531 of the motor 530 and a belt coupling unit 502 to which the belt 520 is coupled. The rear holder 450 may be coupled to the rear end portion of the rail 440. The rear holder 450 may rotatably support the drive pulley 500. According to an embodiment, the rear holder 450 may include a pulley support surface 451 that supports the rotary shaft 501 of the drive pulley 500, a rail support surface 452 that supports the rear end portion of the rail 440, and a bottom plate fastening groove 453 for being coupled to a bottom plate cover 600. According to an embodiment, the rear holder 450 may also include a bottom plate fastening protrusion (not shown) instead of the bottom plate fastening groove 453.

Figure 9:
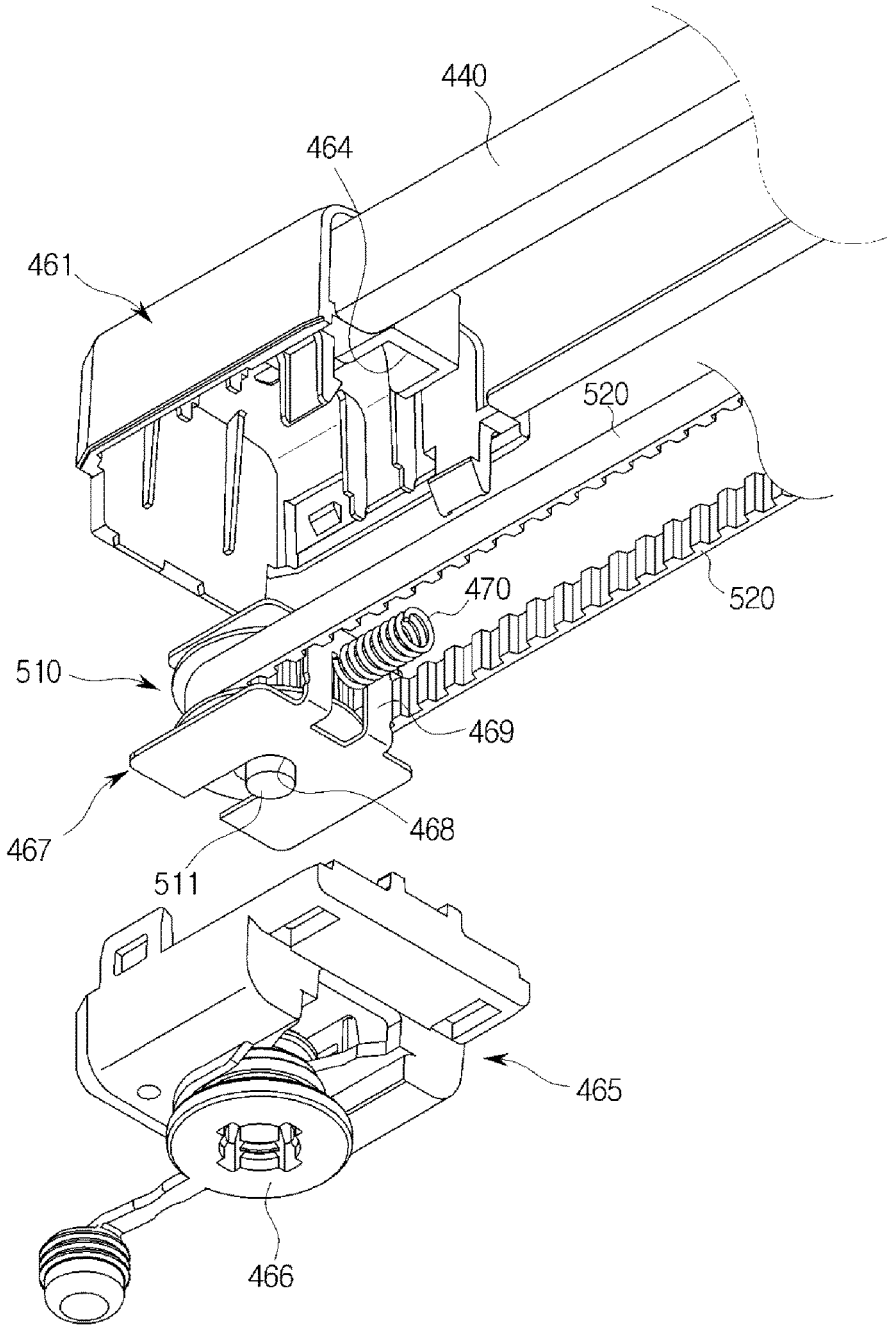
FIG. 9 is a view illustrating an embodiment of the rail, the belt, an idle pulley, and a front holder of the moving module.
Figure 10:
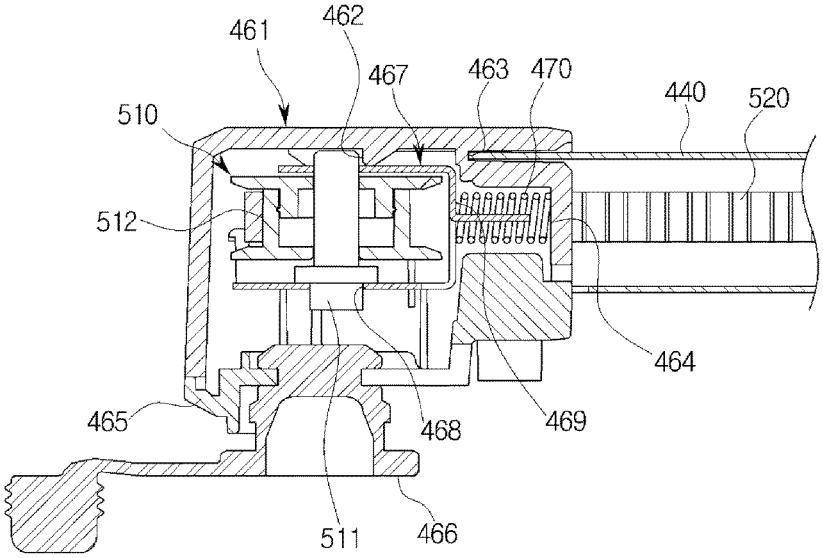
FIG. 10 is a cross-sectional view of the embodiment of the rail, the belt, the idle pulley, and the front holder of the moving module.

FIG. 9 is a view illustrating an embodiment of the rail, the belt, an idle pulley, and a front holder of the moving module, and FIG. 10 is a cross-sectional view of the embodiment of the rail, the belt, the idle pulley, and the front holder of the moving module. The idle pulley 510 may include a rotary shaft 511 and a belt coupling unit 512 to which the belt 520 is coupled. The front holder 460 may include a front top holder 461, a front bottom holder 465 coupled to a lower portion of the front top holder 461, and a pulley bracket 467 disposed between the front top holder 461 and the front bottom holder 465. The front top holder 461 may include a pulley support surface 462 that supports the rotary shaft 511 of the idle pulley 510, and a rail support surface 463 that supports the front end portion of the rail 440. The front bottom holder 465 may be coupled to the lower portion of the front top holder 461 by a locking structure. According to an embodiment, the front bottom holder 465 may include a bottom plate coupling protrusion 466 coupled to the bottom plate 35 of the wash tub 30. According to another embodiment, the front bottom holder 465 may also include a bottom plate fastening groove (not shown) for coupling to the bottom plate 35 of the wash tub 30. The pulley bracket 467 may be movably provided along the longitudinal direction of the rail 440 and may rotatably support the idle pulley 510. The pulley bracket 467 may include a pulley support surface 468 that supports the rotary shaft 511 of the idle pulley 510.

The rail 440, the belt 520, the drive pulley 500, the rear holder 450, the idle pulley 510, and the front holder 460 may be assembled to each other by a tension of the belt 520. In other words, the drive pulley 500 is pressed in a direction approaching the rail 440 by the tension of the belt 520, and a force is transmitted to the rear holder 450 through the pulley support surface 451 of the rear holder 450 such that the rear holder 450 is adhered and coupled to the rear end portion of the rail 440. In addition, the idle pulley 510 is pressed in a direction approaching the rail 440 by the tension of the belt 520, and a force is transmitted to the front holder 460 through the pulley support surface 462 of the front holder 460 such that the front holder 460 is adhered and coupled to the front end portion of the rail 440. Meanwhile, the front holder 460 may further include an elastic member 470 for maintaining the tension of the belt 520. The elastic member 470 may also be provided at the rear holder 450. The elastic member 470 may provide a function of preventing the tension of the belt 520 from decreasing due to thermal expansion of the belt 520 caused by hot air inside the wash tub 30. One end portion of the elastic member 470 may be supported by the front holder 460, and the other end portion of the elastic member 470 may be supported by the pulley bracket 467. For this, elastic member support surfaces 464 and 469 may be respectively formed at the front holder 460 and the pulley bracket 467. The elastic member 470 may be a compression spring.

Figure 11:
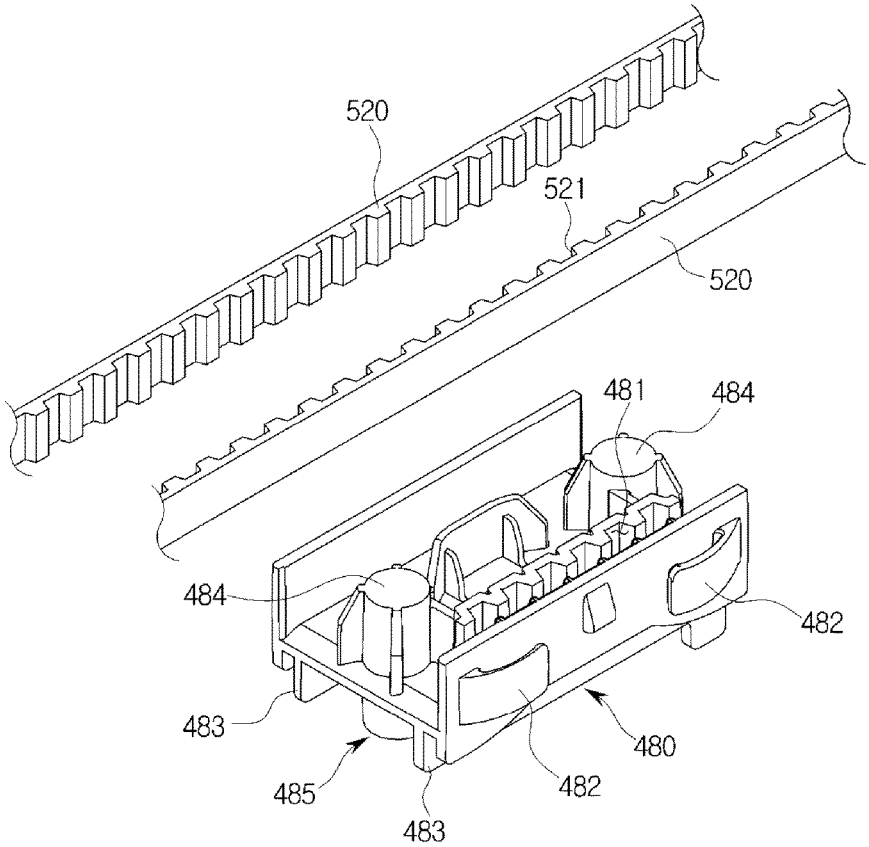
FIG. 11 is a view illustrating the belt and a belt holder of the moving module.

FIG. 11 is a view illustrating the belt and a belt holder of the moving module. The moving body 490 may include a belt holder 480 that may be disposed in the inner space 441 of the rail 440 to linearly reciprocate by being coupled to the belt 520, and a reflecting module holder 490*a* disposed outside the rail 440 to linearly reciprocate by being coupled to the belt holder 480 and to which the reflecting module 400 is detachably coupled. The belt holder 480 and the reflecting module holder 490*a* may be coupled and fixed by a fastening member 490*b* such as a bolt.

Like the belt 520, the belt holder 480 may be disposed in the inner space 441 of the rail 440. A toothed form coupling part 481 coupled to the toothed form 521 of the belt 520 may be provided at the belt holder 480 so that the belt holder 480 moves according to movement of the belt 520. In addition, the belt holder 480 may include legs 482 and 483 supported by the rail 440. The legs 482 and 483 may include side legs 482 that protrude sideward to be supported by the side walls 443 of the rail 440 and at least one lower leg 483 that protrudes downward to be supported by the lower wall 444 of the rail 440. The side legs 482 may be provided to be elastically deformable to reduce noise and vibration due to collision and friction with the rail 440 when the belt holder 480 moves and allow the belt holder 480 to smoothly move. The side legs 482 may be an elastic body of one type of a plate spring. The belt holder 480 may also include a fastening structure 484. The fastening structure 484 of the belt holder 480 may include a fastening hole 485 into which the fastening member 490*b* is inserted to be coupled to the reflecting module holder 490*a*.

Figure 12:
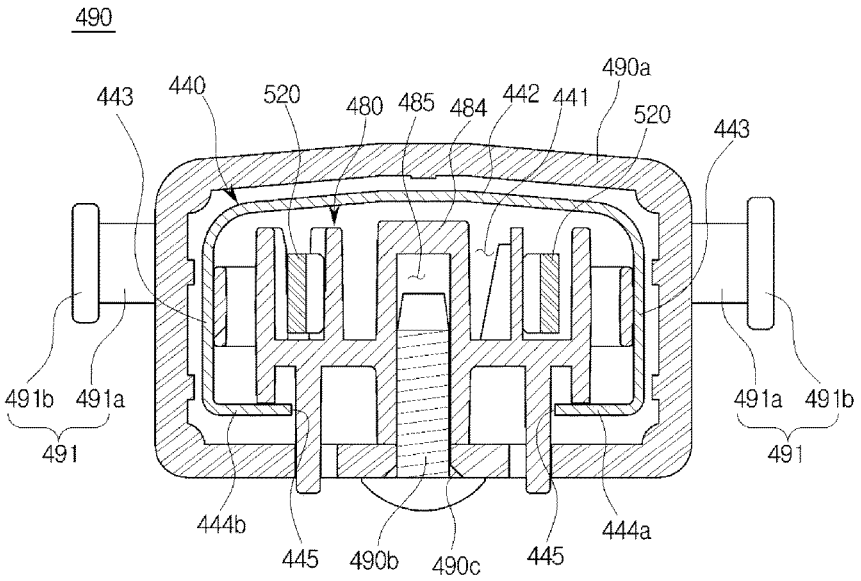
FIG. 12 is a lateral cross-sectional view of an embodiment of the moving module.

The reflecting module holder 490*a* may be coupled to the belt holder 480 to move together with the belt holder 480 and may transmit the driving force of the belt holder 480 to the reflecting module 400. FIG. 12 is a lateral cross-sectional view of an embodiment of the moving module. As illustrated in FIG. 8, the reflecting module holder 490*a* may be provided to surround an outer surface of the rail 440. According to an embodiment, the reflecting module holder 490*a* may also surround the entire outer surface of the rail 440 or may surround only a part of the outer surface. The reflecting module holder 490*a* may be coupled to the belt holder 480 through the lower opening 445 of the rail 440. The reflecting module holder 490*a* may have a fastening hole 490*c*. The fastening hole 490*c* of the reflecting module holder 490*a* may be fastened to the fastening hole 485 of the belt holder 480 by the fastening member 490*b*. Accordingly, the reflecting module holder 490*a* and the belt holder 480 may be coupled to each other. The reflecting module holder 490*a* may include a second coupling member such as a coupling protrusion unit 491 coupled to a first coupling member of the reflecting module 400. According to an embodiment, the second coupling member may be formed at an outer surface of the reflecting module holder 490*a*. The first coupling member and the second coupling member may be detached from each other.

Hereinafter, the reflecting module 400 and several embodiments in which the reflecting module 400 and the moving body 490 are detachably coupled to each other will be described with reference to FIGS. 13 to 19.

Figure 13:
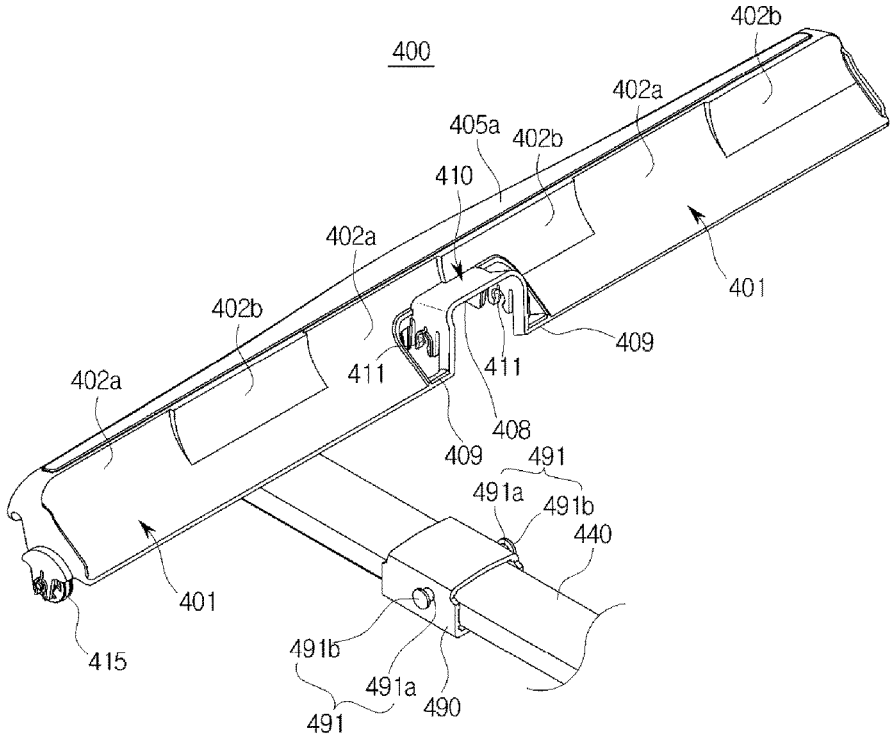
FIG. 13 is a view illustrating a first embodiment of the reflecting module and a moving body.
Figure 14:
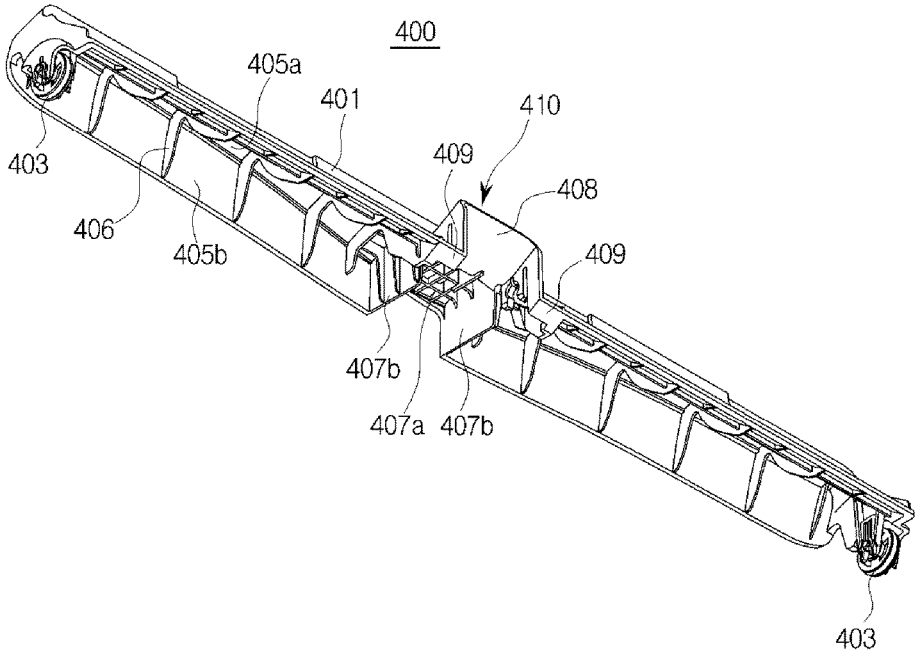
FIG. 14 is a view illustrating a lower surface of the first embodiment of the reflecting module and the moving body.

FIG. 13 is a view illustrating a first embodiment of the reflecting module and the moving body, and FIG. 14 is a view illustrating a lower surface of the reflecting module. According to FIGS. 13 and 14, the reflecting module 400 may include a reflecting unit 401, an upper support unit 405*a*, a rotation locking part 409, a rear support unit 405*b*, a reinforcing rib 406, a horizontal support unit 407*a*, a vertical support unit 407*b*, and a roller 403.

The reflecting unit 401 may reflect the wash water sprayed by the fixed spray nozzle assemblies 330 and 340. The reflecting unit 401 may include reflecting surfaces 402*a* and 402*b* obliquely provided to reflect the wash water. The reflecting surfaces 402*a* and 402*b* may have different slopes to reflect the wash water at different angles. The reflecting surfaces 402*a* and 402*b* having the different slopes may be alternately arranged in the longitudinal direction as illustrated in FIG. 13.

The upper support unit 405*a* may be provided by being bent from an upper end of the reflecting unit 401. The rotation locking part 409 may be pressed by a rotation guide (610 in FIGS. 20 and 21) of the bottom plate cover 600 to allow the reflecting module 400 to rotate. The rear support unit 405*b* may be provided to support the upper support unit 405*a* and the reflecting unit 401, and the reinforcing rib 406 may be provided to reinforce strengths of the reflecting unit 401, the upper support unit 405*a*, and the rear support unit 405*b*. The horizontal support unit 407*a* and the vertical support unit 407*b* may be supported by an upper surface and a side surface of the moving body 490 to allow the reflecting module 400 to stably move along with the movement of the moving body 490. The roller 403 may be provided at both longitudinal ends of the reflecting module 400 or at any position on a lower end of the reflecting module 400 and may provide a function of allowing smooth movement of the reflecting module 400. When the roller 403 is provided at the reflecting module 400, a roller support unit for supporting the roller 403 may be provided at the bottom plate 35 of the wash tub 30. The upper support unit 405*a*, the rotation locking part 409, the rear support unit 405*b*, the reinforcing rib 406, the horizontal support unit 407*a*, the vertical support unit 407*b*, and the roller 403 may be omitted as necessary.

According to the embodiment, the reflecting unit 401 may include a rail coupling unit 410 as illustrated in FIGS. 13 and 14. The rail coupling unit 410 may be formed near the center in a longitudinal direction of the reflecting unit 401. However, the rail coupling unit 410 is not limited to being formed near the center in the longitudinal direction of the reflecting unit 401, it may also be provided on at least one of the both ends of the reflecting unit 401, and it may also be provided on at least one of the center and the both ends of the reflecting unit 401. In addition, only one rail coupling unit 410 or two or more rail coupling units 410 may be provided at the reflecting module 400. The rail coupling unit 410 may include a first coupling member for coupling to a second coupling member provided at the moving body 490. The first coupling member may be a coupling groove 411. The rail coupling unit 410 may further include a rotation stopper unit 408. The rotation stopper unit 408 may provide a function of limiting a range of rotation of the reflecting module 400 when the reflecting module 400 rotates by the rotation guide 610 of the bottom plate cover 600.

Figure 15:
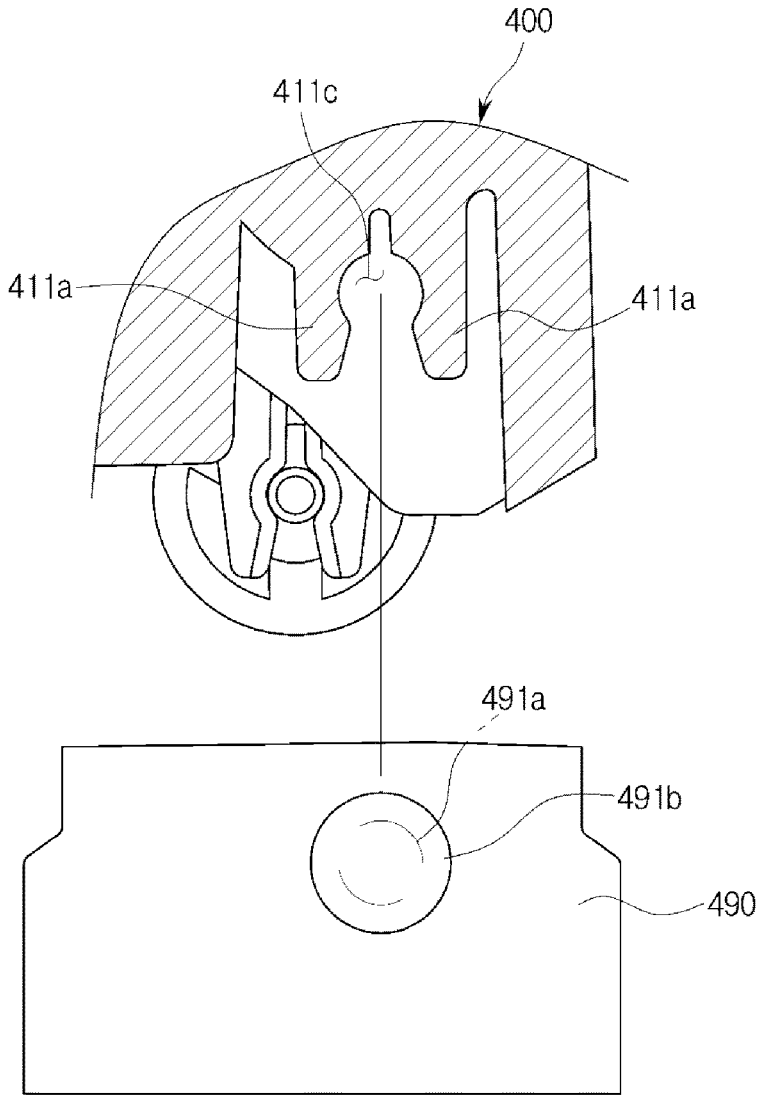
FIG. 15 is a lateral cross-sectional view illustrating the first embodiment of the reflecting module and the moving body.

FIG. 15 is a lateral cross-sectional view illustrating the first embodiment of the reflecting module and the moving body.

As illustrated in FIGS. 13 and 15, according to the first embodiment, the first coupling member may be the first coupling groove 411. As illustrated in FIG. 13, the first coupling groove 411 may be provided as a pair of grooves at the rail coupling unit 410 of the reflecting module 400. According to the embodiment, the first coupling groove 411 of the rail coupling unit 410 may be formed between first elastic hooks 411*a* and 411*b* which are elastically deformable. The first coupling groove 411 may have a circular shape. According to the first embodiment, the second coupling member of the reflecting module holder 490*a* of the moving body 490 may be a first coupling protrusion unit 491 that protrudes sideward. The first coupling protrusion unit 491 may be in a cylindrical shape as illustrated in FIG. 15. The first coupling protrusion unit 491 may be provided at the moving body 490 corresponding to the first coupling groove 411 of the rail coupling unit 410. The first coupling protrusion unit 491 may be provided as a pair of units as illustrated in FIG. 13. According to an embodiment, the first coupling protrusion unit 491 may also include a first coupling shaft part 491*a* and a first deviation prevention part 491*b* formed at an end portion of the first coupling shaft part 491*a* to prevent the deviation of the reflecting module 400. The first elastic hooks 411*a* and 411*b* may be slightly opened during a process in which the coupling shaft part 491*a* of the moving body 490 is inserted into or deviated from the first coupling groove 411 of the reflecting module 400 to allow the first coupling shaft part 491*a* of the moving body 490 to move up to a position of the first coupling groove 411. When the first coupling shaft part 491*a* of the moving body 490 has moved up to the position of the first coupling groove 411, the first elastic hooks 411*a* and 411*b* may be restored to their original states. Consequently, the reflecting module 400 may be mounted on or detached from the moving body 490. When the first coupling protrusion unit 491 is in a cylindrical shape and the first coupling groove 411 is in a circular shape, the first coupling member may rotate about the first coupling shaft part 491*a*.

Figure 16:
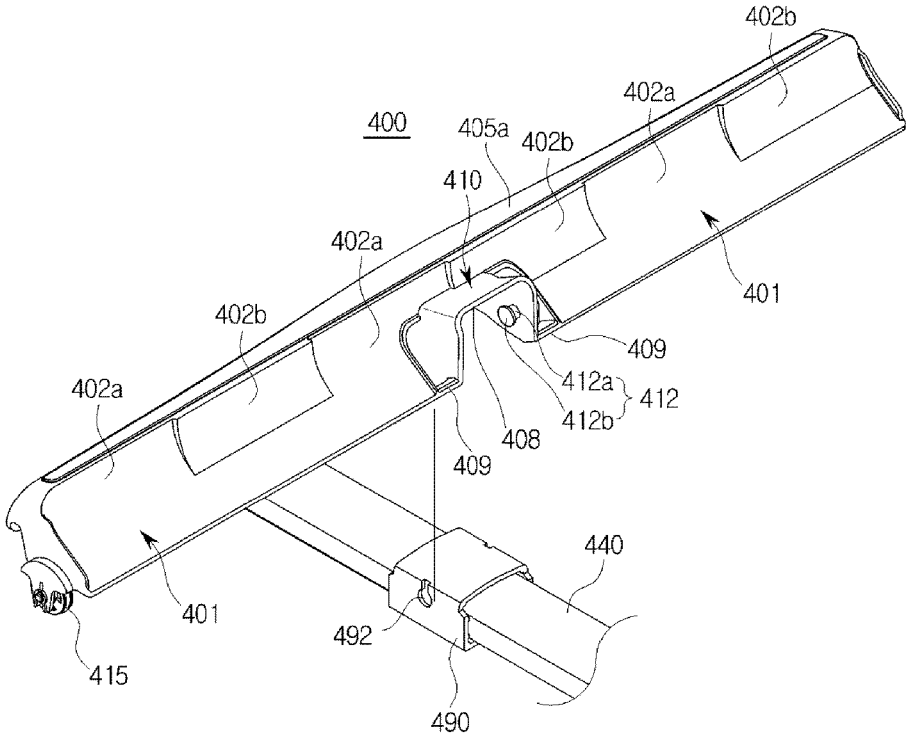
FIG. 16 is a view illustrating a second embodiment of the reflecting module and the moving body.

FIG. 16 is a view for describing a second embodiment of the reflecting module and the moving body.

As illustrated in FIG. 16, according to the second embodiment, the first coupling member may be a second coupling protrusion unit 412. The second coupling protrusion unit 412 may be provided as a pair of units at the rail coupling unit 410 of the reflecting module 400. According to an embodiment, the second coupling protrusion unit 412 may also include a second coupling shaft part 412*a* and a deviation prevention unit 412*b* formed at an end portion of the second coupling shaft part 412*a* to prevent the deviation of the reflecting module 400. According to the second embodiment, the second coupling member of the reflecting module holder 490*a* of the moving body 490 may be a second coupling groove 492. The second coupling groove 492 may also be provided as a pair of grooves at the moving body 490 corresponding to the second coupling protrusion unit 412 of the rail coupling unit 410. According to an embodiment, like the first coupling groove 411 of the rail coupling unit 410 of FIG. 15, the second coupling groove 492 may be formed between second elastic hooks 492*a* and 492*b* which are elastically deformable. Similar to what is described above, the second elastic hooks 492*a* and 492*b* of the second coupling groove 492 of the moving body 490 may be elastically deformed during a process in which the second coupling shaft part 412*a* of the rail coupling unit 410 is inserted into or deviated from the second coupling groove 492 of the moving body 490 and may be restored to their original states when the insertion or the deviation is completed. As a result, the reflecting module 400 may be mounted on or detached from the moving body 490. Similar to the case of the first embodiment, the first coupling member may rotate about the second coupling shaft part 412*a*.

Figure 17:
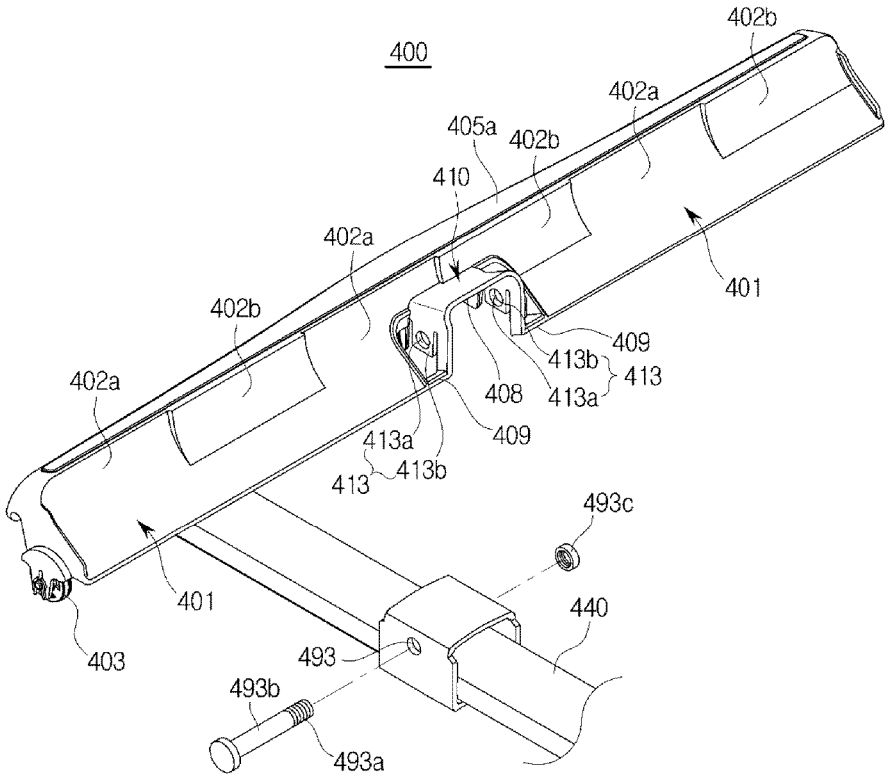
FIG. 17 is a view illustrating a third embodiment of the reflecting module and the moving body.

FIG. 17 is a view for describing a third embodiment of the reflecting module and the moving body.

As illustrated in FIG. 17, according to the third embodiment, the first coupling member of the reflecting module 400 may be a first coupling plate unit 413 that includes a flat plate 413*b* and a third coupling groove 413*a* provided on the flat plate 413*b*. The first coupling plate unit 413 may be provided at the rail coupling unit 410. One first coupling plate unit 413 may be provided at the rail coupling unit 410, and a plurality of first coupling plate units 413 may also be provided as illustrated in FIG. 17. The second coupling member of the moving body 490 may be provided at an outer surface of the moving body 490 and may be a fourth coupling groove 493 corresponding to the third coupling groove 413*a*. The number of fourth coupling grooves 493 may be singular or plural. The third coupling groove 413*a* and the fourth coupling groove 493 may be coupled to each other by a fastening member that may be inserted into and pass through the third coupling groove 413*a* and the fourth coupling groove 493. The fastening member may be, for example, a bolt 493*a* or a pin. The fastening member such as the bolt 493*a* may be inserted into any one third coupling groove 413*a* of the rail coupling unit 410 and then inserted into the fourth coupling groove 493 formed at a side of the moving body 490 to couple the any one third coupling groove 413*a* and the fourth coupling groove 493 formed at the side of the moving body 490 to each other. The fastening member inserted into the third coupling groove 413*a* and the fourth coupling groove 493 may pass through the moving body 490, pass through the fourth coupling groove 493 formed at another side of the moving body 490, and pass through another third coupling groove 413*a* of the rail coupling unit 410 to couple the fourth coupling groove 493 formed at the other side of the moving body 490 and the other third coupling groove 413*a* to each other. When the fastening member is the bolt 493*a*, screw valleys and screw peaks may be formed at one end of the bolt 493*a*. In this case, a nut 493*c* may be coupled to the end of the bolt 493*a* to prevent the bolt 493*a* from freely deviating from the third coupling groove 413*a* and the fourth coupling groove 493 to stably couple the rail coupling unit 410 and the moving body 490 to each other. The reflecting module 400 may be mounted on or detached from the moving body 490 using the fastening member. The first coupling member may be rotated about the fastening member.

Figure 18:
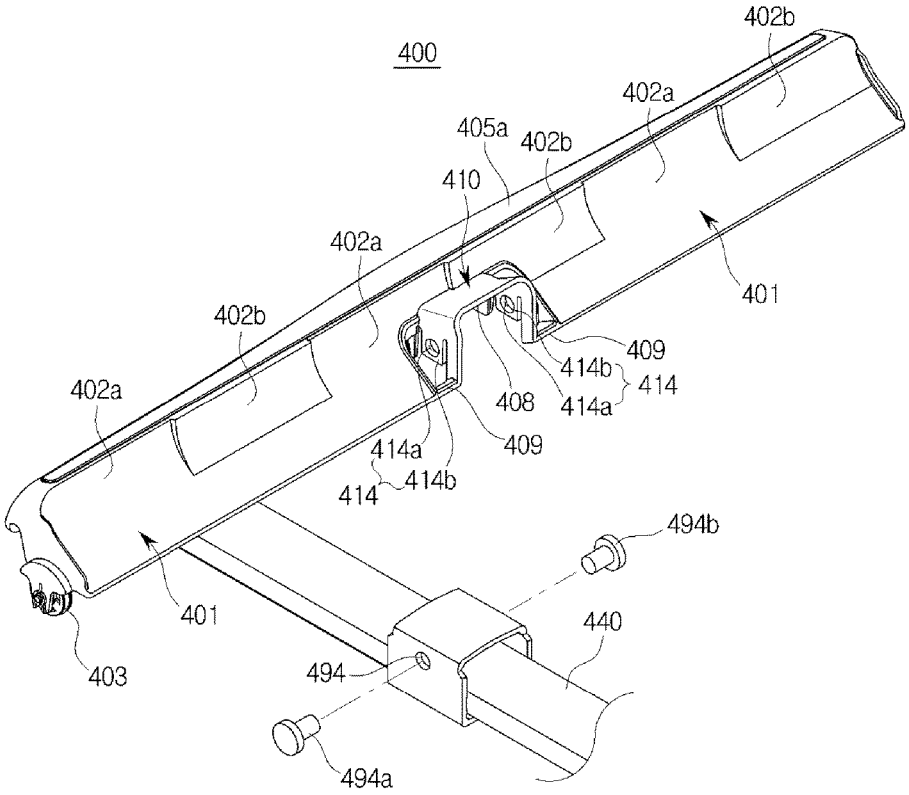
FIG. 18 is a view illustrating a fourth embodiment of the reflecting module and the moving body.

FIG. 18 is a view for describing a fourth embodiment of the reflecting module and the moving body.

As illustrated in FIG. 18, according to the fourth embodiment, the first coupling member of the reflecting module 400 may be a plurality of fifth coupling grooves 414*a* provided at a second coupling plate unit 414 of the rail coupling unit 410, and the second coupling member of the moving body 490 may be a plurality of sixth coupling grooves 494 provided at an outer surface of the moving body 490 and respectively corresponding to the plurality of fifth coupling grooves 414*a*. The fifth coupling grooves 414*a* may be formed at the flat plate 413*b* of the second coupling plate unit 414. The fifth coupling grooves 414*a* and the sixth coupling grooves 494 may be coupled by a fastening member inserted into both of the fifth coupling grooves 414*a* and the sixth coupling grooves 494. The fastening member is, for example, a bolt 494*a* or a pin. Referring to what is illustrated in FIG. 18, the fastening member such as the bolt 494*a* may be inserted into each of the fifth coupling grooves 414*a* and then inserted into each of the sixth coupling grooves 494 corresponding to each of the fifth coupling grooves 414*a* to couple each of the fifth coupling grooves 414*a* and each of the sixth coupling grooves 494 to each other. Screw peaks may be formed at an outer surface of the fastening member and screw valleys corresponding to the screw peaks of the fastening member may be formed at inner surfaces of the fifth coupling grooves 414*a* and the sixth coupling grooves 494 as needed to stably fix each of the fifth coupling grooves 414*a* and each of the sixth coupling grooves 494. The reflecting module 400 may be mounted on or detached from the moving body 490 using the fastening member. As described above, the first coupling member may rotate about the fastening member.

Figure 19:
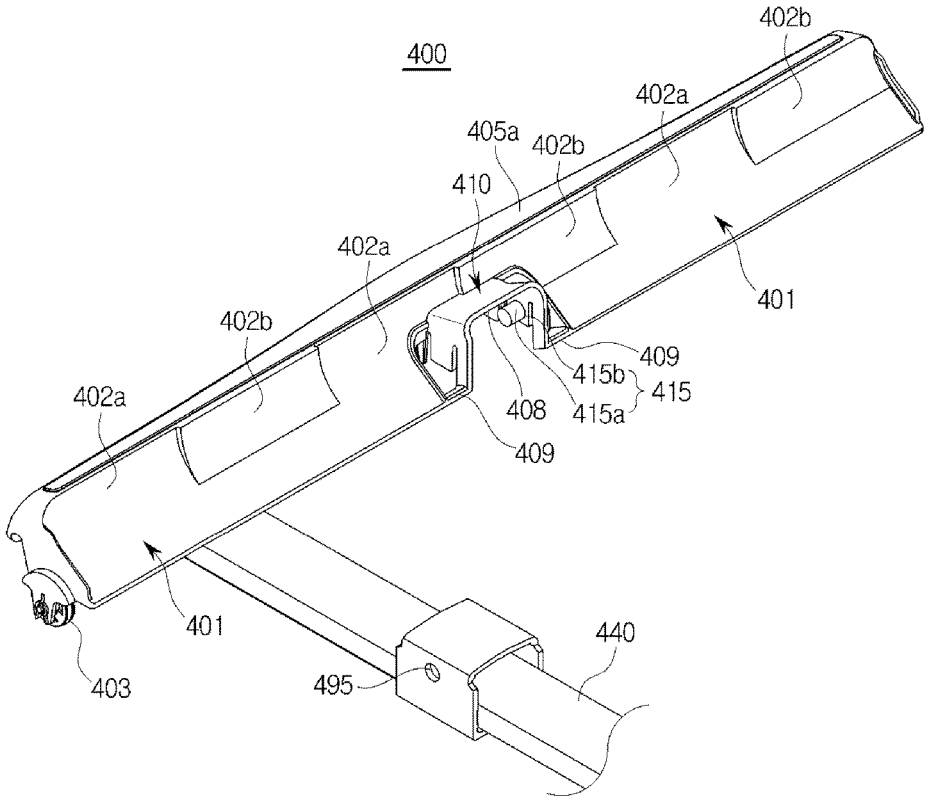
FIG. 19 is a view illustrating a fifth embodiment of the reflecting module and the moving body.

FIG. 19 is a view for describing a fifth embodiment of the reflecting module and the moving body.

As illustrated in FIG. 19, according to the fifth embodiment, the first coupling member may be a third coupling protrusion unit 415. The third coupling protrusion unit 415 may include a protrusion 415*b* protruding toward an inside or outside of the rail coupling unit 410 from an elastic flat plate 415*a* and an elastic flat plate 415*a*. The elastic flat plate 415*a* may be bent toward the inside or the outside of the rail coupling unit 410. The bent elastic flat plate 415*a* may be restored to the original state by an elastic force. The third coupling protrusion unit 415 may be provided as a pair of units at the rail coupling unit 410. According to the fifth embodiment, the second coupling member of the reflecting module holder 490*a* of the moving body 490 may be a seventh coupling groove 495. The seventh coupling groove 495 may be provided corresponding to the protrusion 415*b* of the third coupling protrusion unit 415. In other words, the seventh coupling groove 495 may be provided at a predetermined position of the reflecting module holder 490*a* so that the protrusion 415*b* may be inserted thereinto and may have a predetermined shape. The seventh coupling groove 495 may be provided as a pair of grooves corresponding to the third coupling protrusion unit 415. A user may bend the elastic flat plate 415*a* of the third coupling protrusion unit 415 toward the outside or the inside of the rail coupling unit 410 and then insert the protrusion 415*b* into the seventh coupling groove 495 to couple the rail coupling unit 410 and the reflecting module holder 490*a* to each other. In this case, the protrusion 415*b* and the seventh coupling groove 495 may remain stably coupled to each other by the elastic force of the elastic flat plate 415*a*. As a result, the reflecting module 400 may be mounted on or detached from the moving body 490. The first coupling member may rotate about the protrusion 415*b*.

Figure 20:
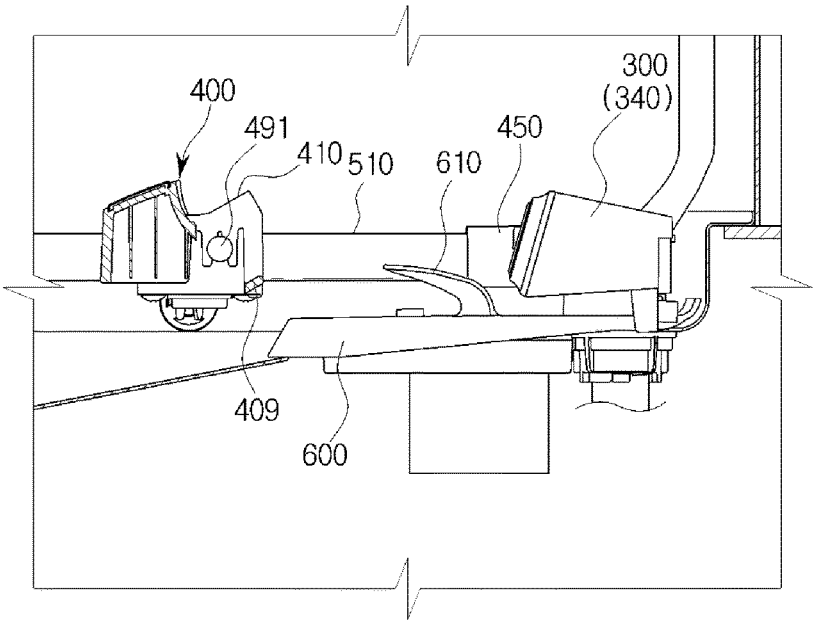
FIGS. 20 to 22 are views for describing an operation of the reflecting module.
Figure 21:
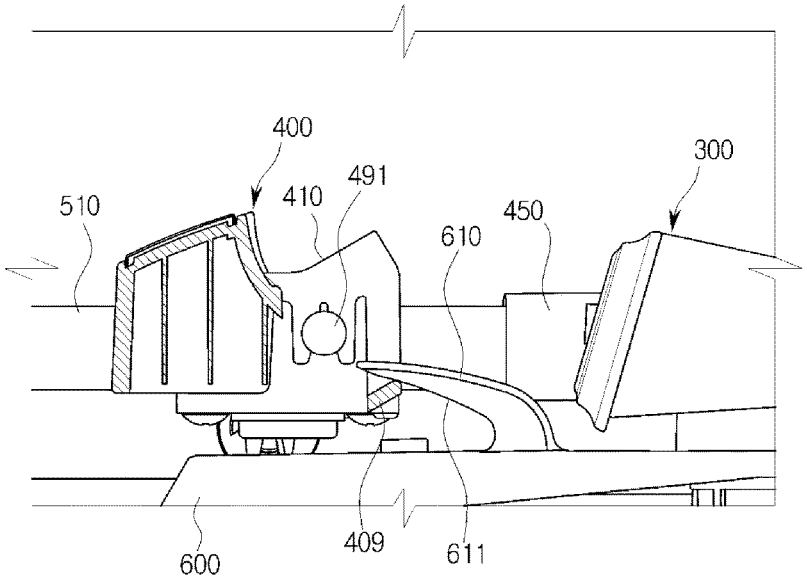
Figure 22:
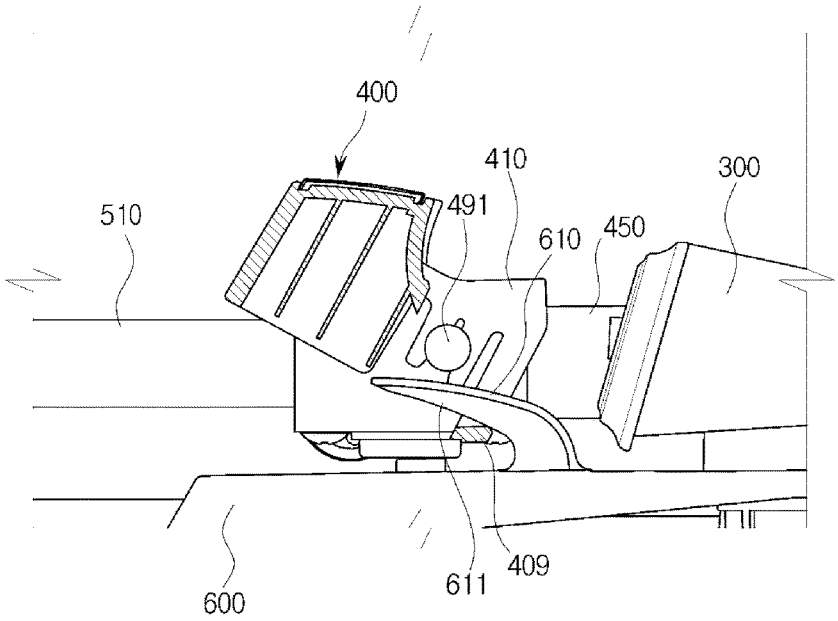
Figure 23:
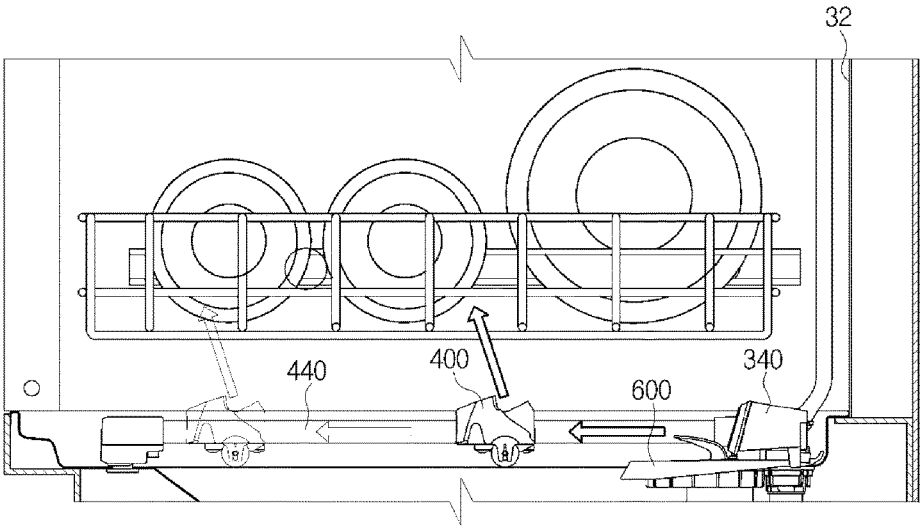
FIGS. 23 and 24 are views for describing a process of the reflecting module reflecting wash water.
Figure 24:
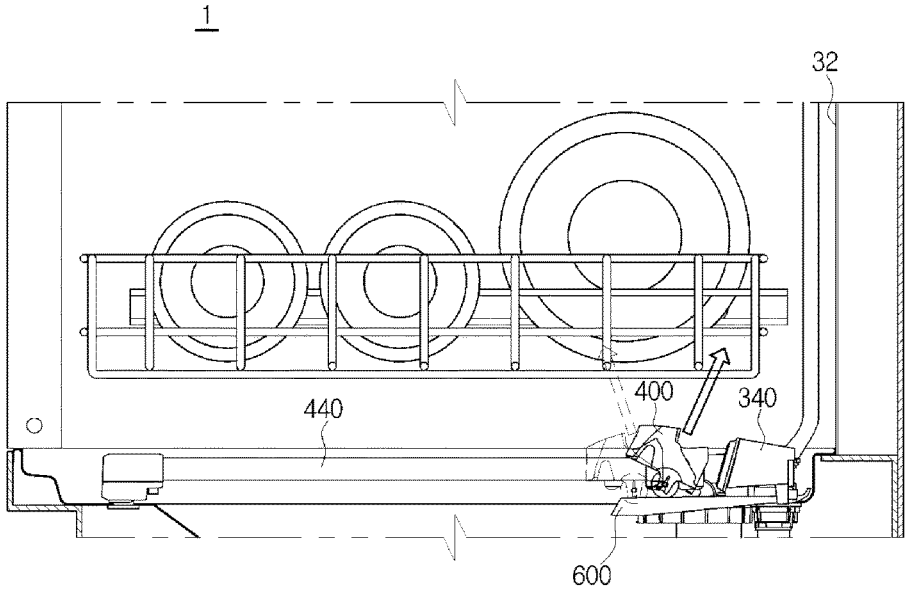

Hereinafter, an operation of the reflecting module will be described with reference to FIGS. 20 to 24. FIGS. 20 to 22 are views for describing an operation of the reflecting module, and FIGS. 23 and 24 are views for describing a process of reflecting wash water by the reflecting module. As described above, when the fixed spray nozzle assemblies 330 and 340 of the dishwasher 1 spray wash water, the sprayed wash water may be reflected toward dishes by the reflecting module 400. Consequently, the reflecting module 400 may be disposed at a position at which the wash water sprayed from the fixed spray nozzle assemblies 330 and 340 may be reflected. When the fixed spray nozzle assemblies 330 and 340 substantially horizontally spray wash water, the reflecting module 400 may be disposed substantially horizontal to fixed spray nozzle assemblies 330 and 340.

According to FIGS. 20 to 22, the bottom plate cover 600 may include the rotation guide 610 that protrudes to guide movement of the reflecting module 400. Meanwhile, as described above, the reflecting module 400 may include the rotation locking part 409 to interfere with the rotation guide 610. The rotation locking part 409 forms a rotation shaft of the reflecting module 400 while being formed above the coupling protrusion unit 491 of the reflecting module holder 490*a* that transmits the driving force to the reflecting module 400. The rotation guide 610 may include a guide surface 611 formed as a curved surface to come into contact with the rotation locking part 409 and allow the reflecting module 400 to smoothly rotate. As illustrated in FIG. 21, when the reflecting module 400 reaches the rotation locking part 409 while moving toward the fixed spray nozzle assemblies 300 and 340 along the rail 440, the rotation locking part 409 of the reflecting module 400 may interfere with the guide surface 611 of the rotation guide 610. When the first coupling member is the first coupling groove 411 and the second coupling member is the first coupling protrusion unit 491 as illustrated in FIGS. 13 to 15, the reflecting module 400 may rotate about the first coupling protrusion unit 491 as illustrated in FIG. 22. Consequently, as illustrated in FIGS. 23 and 24, a direction in which the wash water reflected by the reflecting module 400 moves when the reflecting module 400 is disposed at a section away from the fixed spray nozzle assemblies 330 and 340 and a direction in which the wash water reflected by the reflecting module 400 moves when the reflecting module 400 is disposed at a section near the fixed spray nozzle assemblies 330 and 340 may be different from each other.

Figure 25:
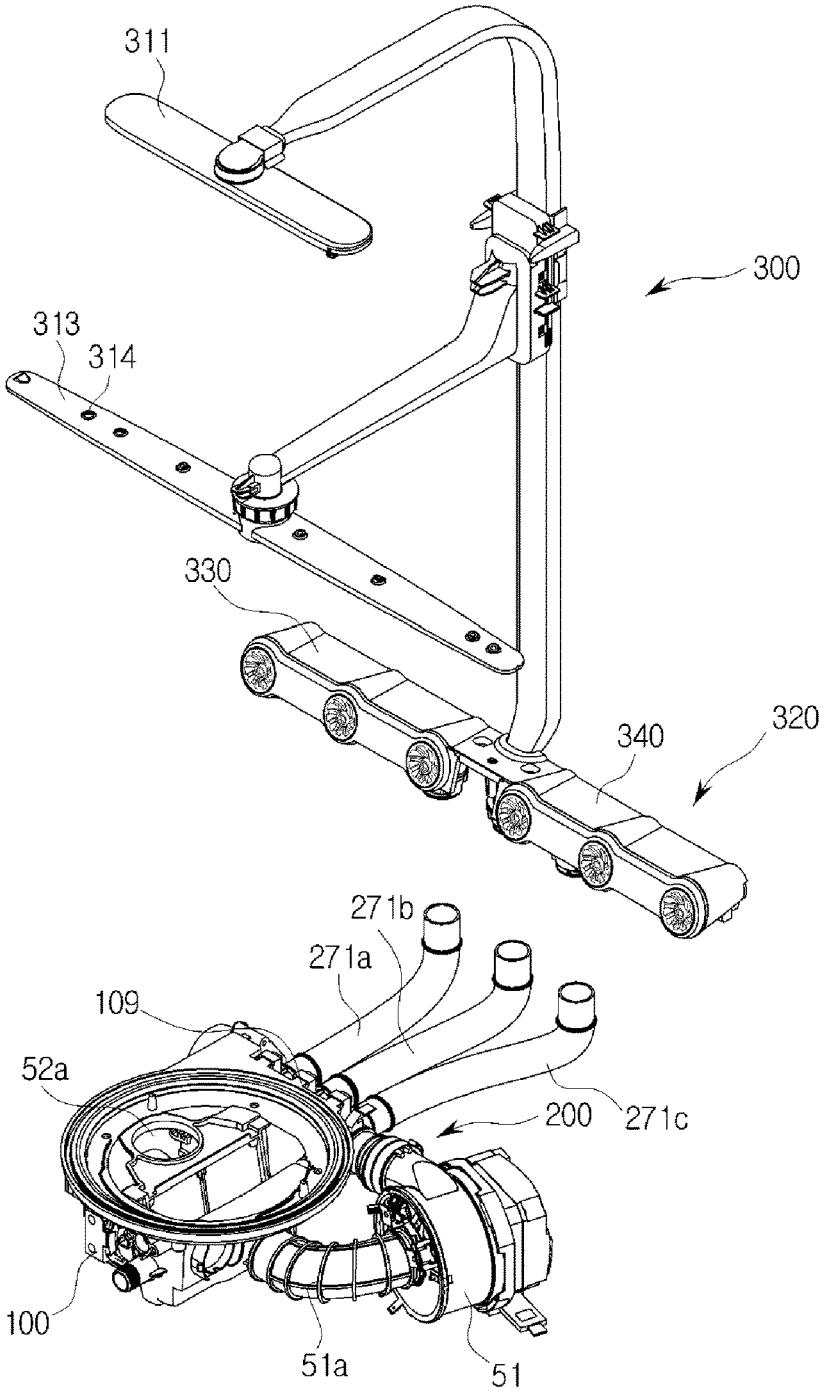
FIG. 25 is a view illustrating a flow channel structure of the dishwasher.

Hereinafter, a flow channel structure will be described with reference to FIG. 25. FIG. 25 is a view illustrating a flow channel structure of the dishwasher. Referring to what is illustrated in FIGS. 3 and 25, the wash tub 30 may include the sump 100 that retains wash water, the circulation pump 51 that pumps the wash water in the sump 100 to supply the wash water to the nozzle assembly 300, and a drainage pump 52 that discharges the wash water in the sump 100 to the outside of the main body 10 together with scraps. A circulation pipe 51*a* that is a passage of wash water moving to the circulation pump 51 and a drainage hole 52*a* for discharging the wash water and scraps to the outside may be provided in the sump 100. The circulation pump 51 may be connected to a distribution device 200 that distributes wash water to each of the nozzle assemblies 311, 313, 330, and 340 of the nozzle assembly 300. The distribution device 200 may be connected to the nozzle assembly 300 via a hose to distribute the wash water to each of the nozzle assemblies 311, 313, 330, and 340. Meanwhile, each of the nozzle assemblies 311, 313, 330, and 340 may spray the wash water onto dishes or the reflecting module 400. The wash water used in washing dishes may move to a lower end of the wash tub 30 and be stored in the sump 100.

Hereinafter, a washing process of the dishwasher 1 will be described. The dishwasher 1 may wash dishes according to a water supply process, a washing process, a draining process, and a drying process. The water supply process refers to a process in which wash water is supplied into the wash tub 30 through a water supply pipe (not shown). The wash water supplied into the wash tub 30 may flow into the sump 100 provided at the lower portion of the wash tub 30 by a gradient of the bottom plate 35 of the wash tub 30 and be stored in the sump 100. The washing process refers to a process of performing dish washing. In the washing process, the circulation pump 51 may be operated to pump the wash water in the sump 100, and the pumped wash water may be distributed to each of the nozzle assemblies 311, 313, and 320 of the nozzle assembly 300. The wash water pumped by the circulation pump 51 in the washing process may be distributed to at least one of the rotary nozzles 311 and 313, the left fixed nozzle 330, and the right fixed nozzle 340 by the distribution device 200. According to an embodiment, the left fixed nozzle 330 may receive the wash water from the distribution device 200 through a first hose 271*a*, and the upper rotary nozzle assembly 311 and the middle rotary nozzle assembly 313 may receive the wash water from the distribution device 200 through a second hose 271*b*. The wash water may be sprayed with high pressure by each of the nozzle assemblies 311, 313, 330, and 340 by a pumping force of the circulation pump 51. The sprayed wash water may directly reach dishes or may reach the dishes after being reflected by the reflecting module 400 to wash the dishes. The wash water sprayed by the nozzle assemblies 311, 313, 330, and 340 may strike the dishes to remove scraps on the dishes and may fall together with the scraps to be stored in the sump 100 again. The circulation pump 51 may pump the wash water stored in the sump 100 again to circulate the wash water within the flow channel structure of the dishwasher to repeat the process described above. During the washing process, the circulation pump 51 may repeat being operated and stopped at least once. The operation and stoppage of the circulation pump 51 may be performed based on a predefined pattern. The predefined pattern may be defined by a user or may be defined by a designer of the apparatus. The scraps that have fallen into the sump 100 together with the wash water in the washing process may be collected by a filter mounted on the sump 100. Consequently, the scraps remain in the sump 100 without being circulated. The draining process refers to a process of draining the scraps remaining in the sump 100 to the outside of the main body 10. The draining process may be performed according to an operation of the drainage pump 52. During the draining process, the wash water may be drained to the outside together with the scraps. The drying process refers to a process of drying washed dishes. The drying process may be performed by operating a heater (not shown) mounted on the wash tub 30.

Figure 26:
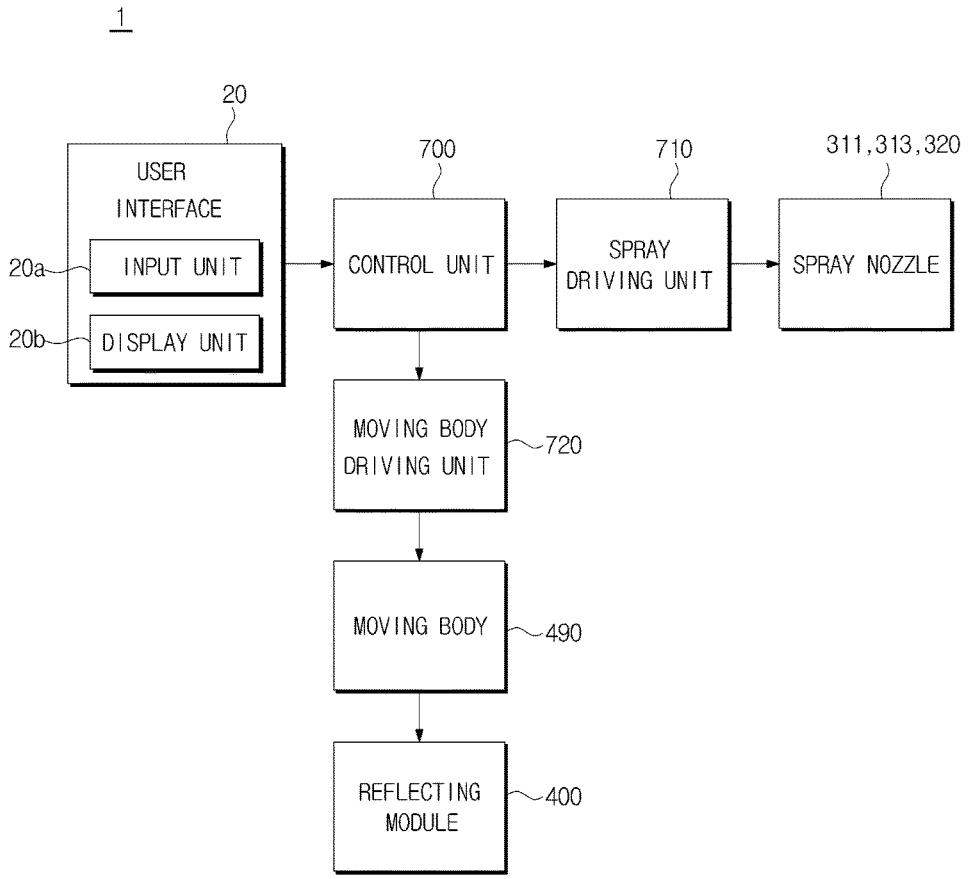
FIG. 26 is a structural view of a dishwasher for describing a process of controlling the dishwasher.

FIG. 26 is a structural view of a dishwasher for describing a process of controlling the dishwasher. According to FIG. 26, the dishwasher 1 may include the user interface 20, a control unit 700, a spray driving unit 710, a moving body driving unit 720, the spray nozzles 311, 313, and 320, the moving body 490, and the reflecting module 400.

Figure 27:
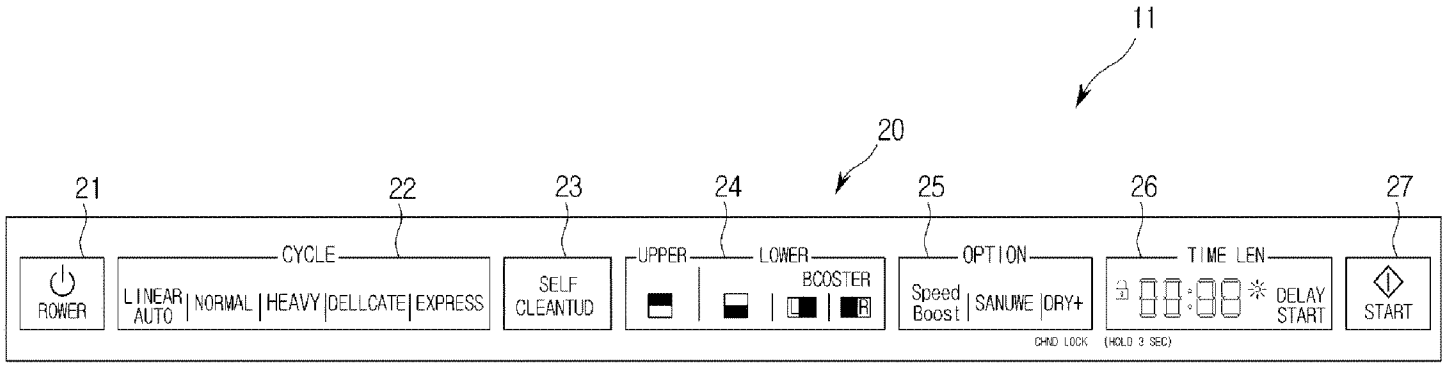
FIG. 27 is a view illustrating an embodiment of a user interface of the dishwasher.

The user interface 20 may be provided at the outer surface of the main body 10 as described above. The user interface 20 may include the input unit 20*a* or the display unit 20*b* as described above. FIG. 27 is a view illustrating an embodiment of a user interface of the dishwasher. As illustrated in FIG. 27, according to an embodiment, the user interface 20 may include a plurality of buttons 21 to 25 and 27 to receive an instruction from the user. The plurality of buttons 21 to 25 and 27 may include a power button 21 to operate the dishwasher 1, a washing method selection button 22 to select a dish washing method, a cleaning mode selection button 23 to operate the dishwasher 1 in the cleaning mode, a washing position selection button 24 to select a position for washing, an option button 25 to select various types of settings, and a washing start button 27 to instruct the dishwasher 1 to start the washing operation. In addition, the user interface 20 may include a display unit 26 to display washing time, remaining washing time, a current operation mode, or various types of errors.

The control unit 700 may control an operation of the dishwasher 1 according to a user's instruction input through the input unit 20*a* of the user interface 20 or predefined settings. According to an embodiment, the control unit 700 may determine at least one control mode among a plurality of control modes for controlling the dishwasher and may also control the operation of the dishwasher 1 according to the determined control mode. In this case, the plurality of control modes may include a dish washing mode, an operation standby mode, and a cleaning mode. The dish washing mode is a mode for performing an operation of washing dishes. In the case of the dish washing mode, the control unit 700 may transmit a control command to the spray driving unit 710 or the moving body driving unit 720 to allow dishes to be washed. The operation standby mode is a mode for waiting to prepare dish washing or receive a new instruction and the like. In the case of the operation standby mode, the control unit 700 may cut off power applied to various types of parts or devices that are not operating to minimize standby power. The cleaning mode is a mode for performing various types of operations for washing the inside of the wash tub 30 or cleaning the reflecting module 400. In addition, the control unit 700 may generate various control commands other than the above to control an overall operation of the dishwasher 1. For example, the control unit 700 may control the door 11 not to open during the dish washing mode and may control the door 11 to open during the cleaning mode.

The control unit 700 may be implemented with a semiconductor chip and a printed circuit board on which the semiconductor chip may be installed. The semiconductor chip may perform at least one of controlling, computing, and storing functions. The semiconductor chip and the printed circuit board may be installed at any place of the dishwasher 1 according to the designer's choice. For example, the semiconductor chip and the printed circuit board may be installed inside a housing that forms the door 11 of the dishwasher 1 or may be installed at an upper portion or lower portion of the main body 10 of the dishwasher 1.

The spray driving unit 710 may generate a driving force to allow the wash water to be sprayed by the nozzles 311, 313, 330, and 340 according to a control command of the control unit 700. According to an embodiment, the spray driving unit 710 may include the circulation pump 51 and the drainage pump 52.

The moving body driving unit 720 may generate a driving force that moves the moving body 490 to which the reflecting module 400 is coupled in a predetermined direction to allow the reflecting module 400 to move inside the wash tub 30. The moving body driving unit 720 may include the motor 530 connected to the drive pulley 500. According to an embodiment, the moving body driving unit 720 may also include a pneumatic actuator or a hydraulic actuator.

Figure 28:
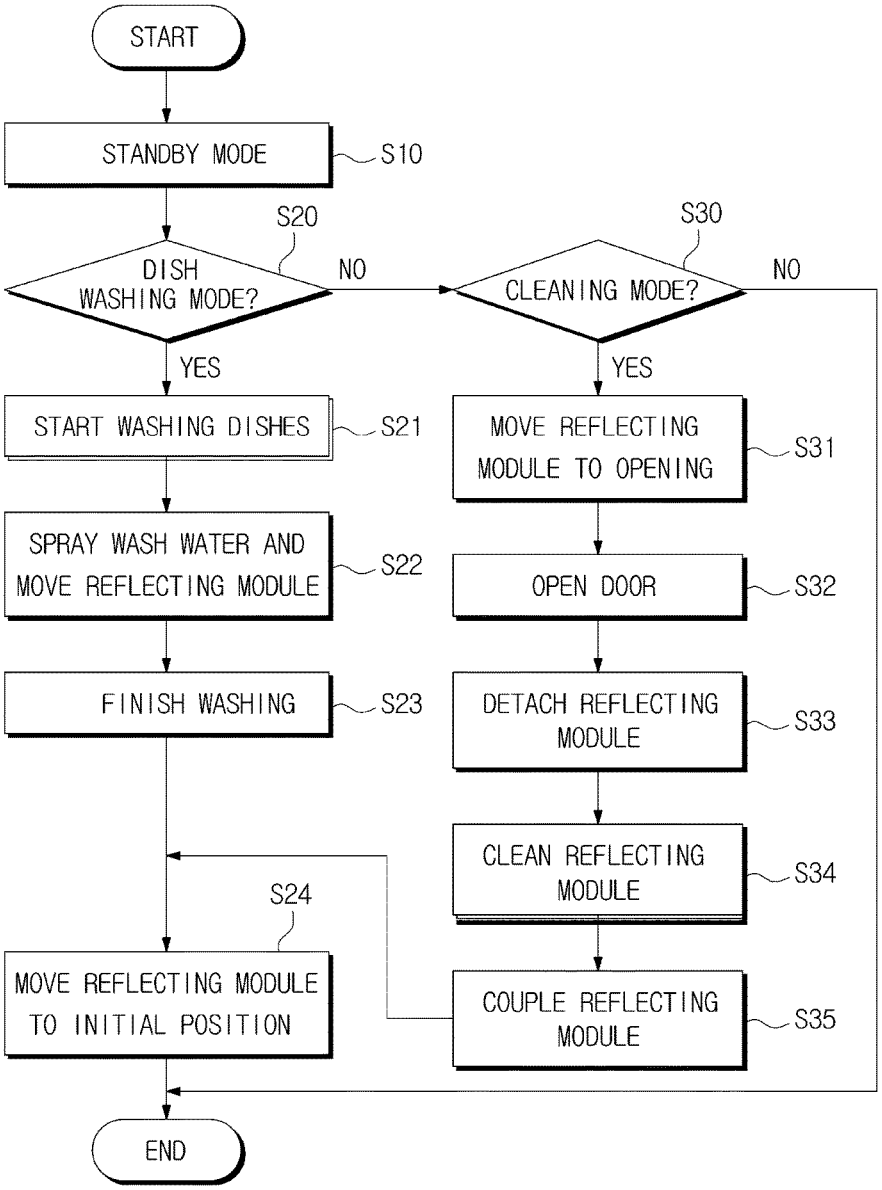
FIG. 28 is a flowchart of an embodiment of a method for controlling a dishwasher.
Figure 29:
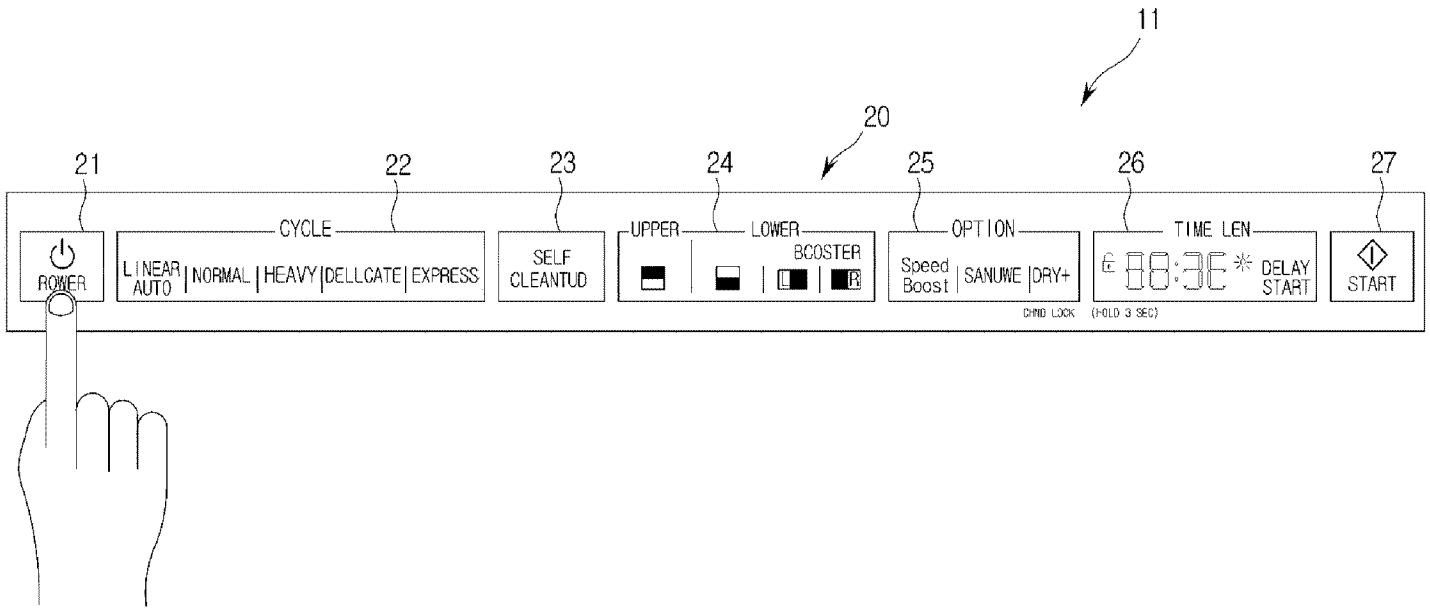
FIGS. 29 and 30 are views for describing an operation of the dishwasher in an operation standby mode.
Figure 30:
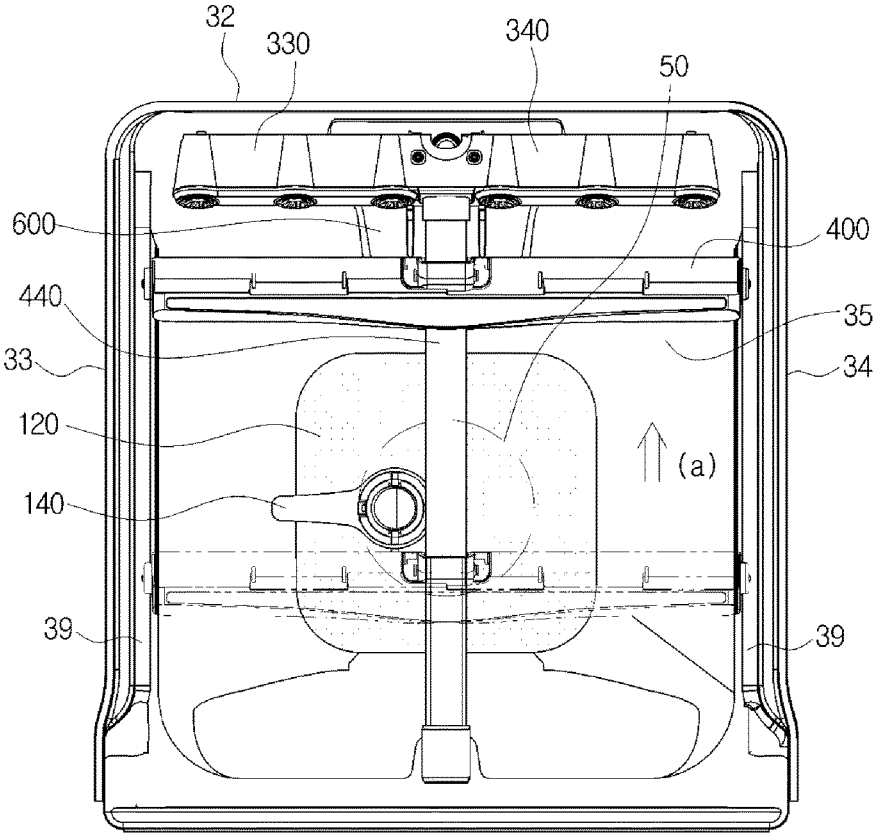

FIG. 28 is a flowchart of an embodiment of a method for controlling a dishwasher. According to an embodiment of a method for controlling the dishwasher 1, first, the dishwasher 1 may operate in an operation standby mode (S10). Of course, according to an embodiment, the dishwasher 1 may not always have to operate in the operation standby mode. FIGS. 29 and 30 are views for describing an operation of the dishwasher in an operation standby mode. As illustrated in FIGS. 28 and 29, when a user manipulates the power button 21 of the dishwasher 1, power is applied to the dishwasher 1, and the control unit 700 may generate a control command related to an operation standby mode. Then, the dishwasher 1 may operate in the operation standby mode for preparing dish washing. In the operation standby mode, the dishwasher 1 may wait until the user's instruction is input through the input unit 20*a* and the like. According to FIG. 30, a position of the reflecting module 400 inside the wash tub 30 may be initialized in the operation standby mode. In other words, the reflecting module 400 may move to an initial position provided near the fixed spray nozzle assembly 320 from a random position 400*a* (a).

Figure 31:
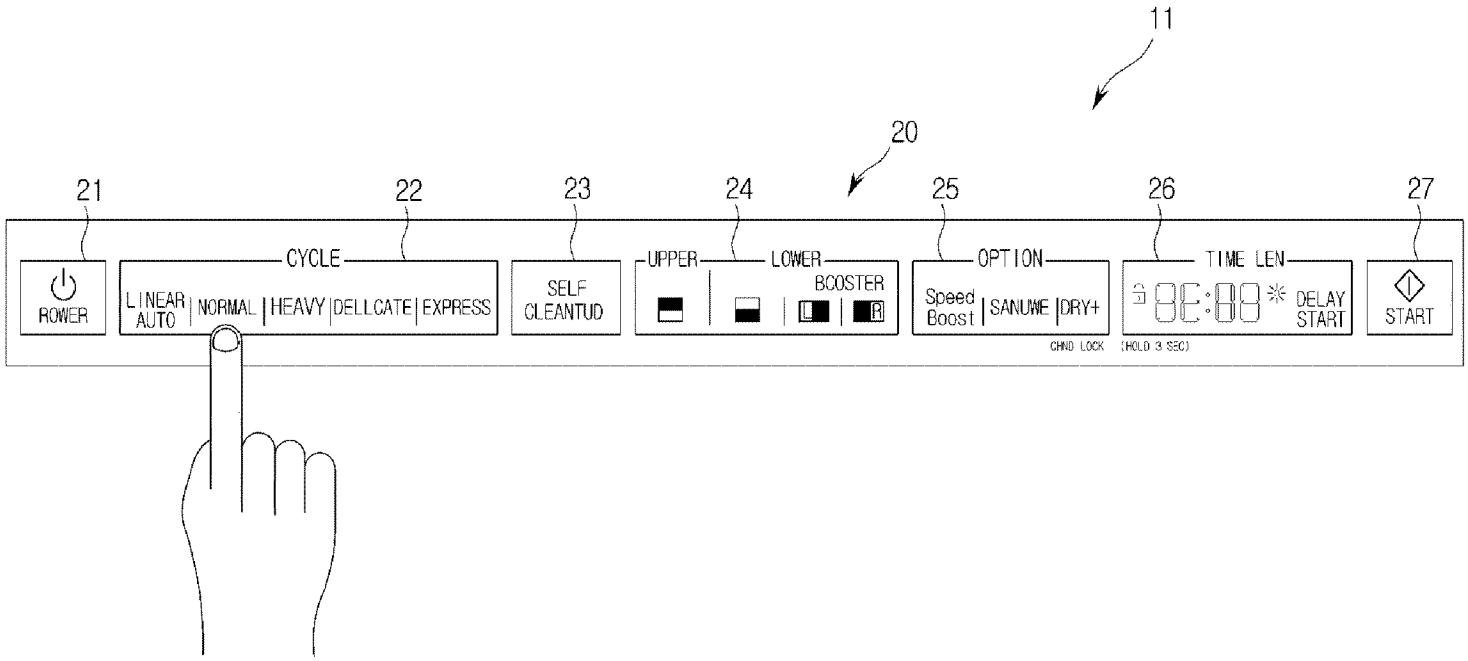
FIGS. 31 to 33 are views for describing an operation of the reflecting module in a dish washing mode.
Figure 32:
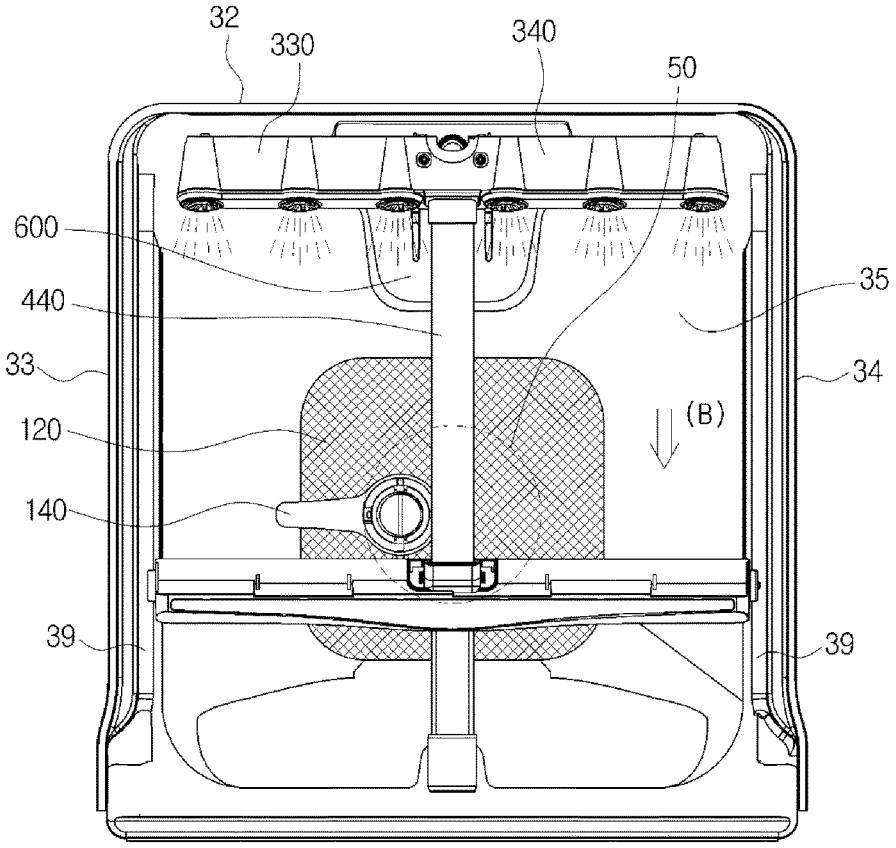
Figure 33:
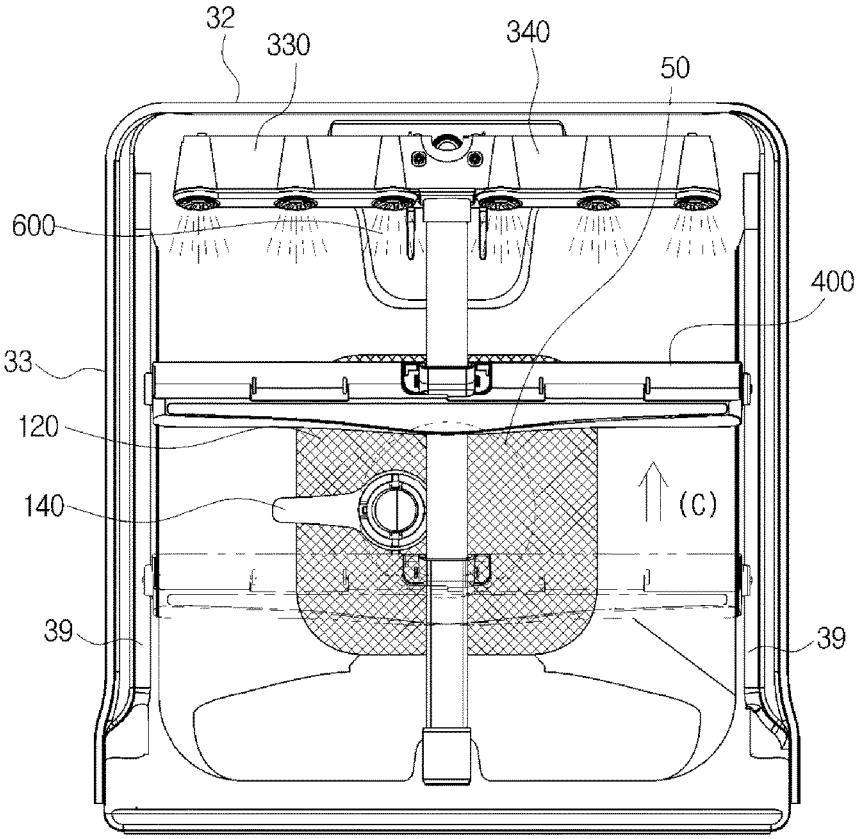

FIGS. 31 to 33 are views for describing an operation of the reflecting module in a dish washing mode. When the user manipulates at least one of the washing method selection button 22 and the washing start button 27 as illustrated in FIG. 31 and the dish washing mode is selected (S20), the control unit 700 may generate a control command according to the dish washing mode and may transmit the control command to the spray driving unit 710 and the moving body driving unit 720 to perform dish washing (S21). In the dish washing mode, the reflecting module 400 may reflect the wash water sprayed by the fixed nozzles while moving in an opposite direction (b) of the fixed nozzle assembly 320 or in a direction (c) toward the fixed nozzle assembly 320 together with the moving body 490 that moves by the motor 530 and the belt 520 (S22).

When the dish washing is finished, an operation of the spray driving unit 710, e.g. the circulation pump 51, ends and each of the nozzles 311, 313, 330, and 340 of the nozzle assembly 300 no longer sprays the wash water (S23). Furthermore, an operation of the moving body driving unit 720, e.g. the motor 530, also ends and the moving body 490 and the reflecting module 400 coupled to the moving body 490 may also not operate. According to an embodiment, the reflecting module 400 may move to the initial position (a) as illustrated in FIG. 30 after the dish washing is finished (40).

Figure 34:
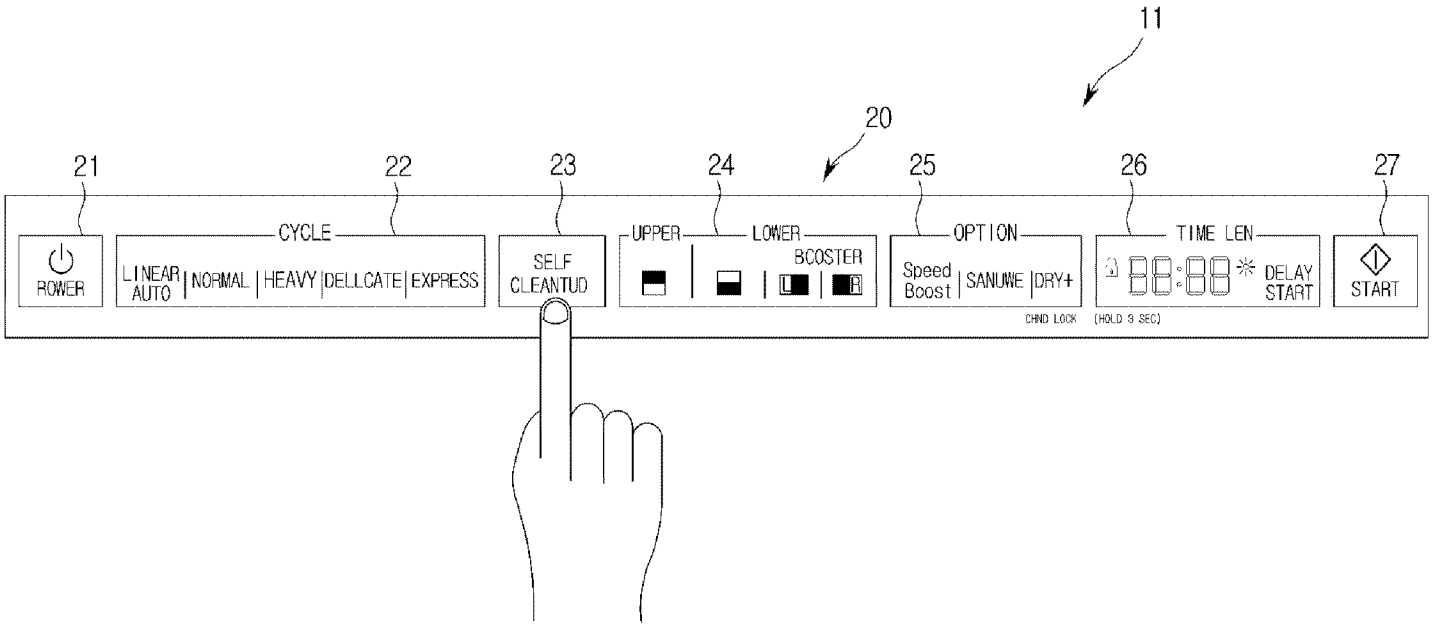
FIGS. 34 to 39 are views for describing a process of cleaning the reflecting module in a cleaning mode.
Figure 35:
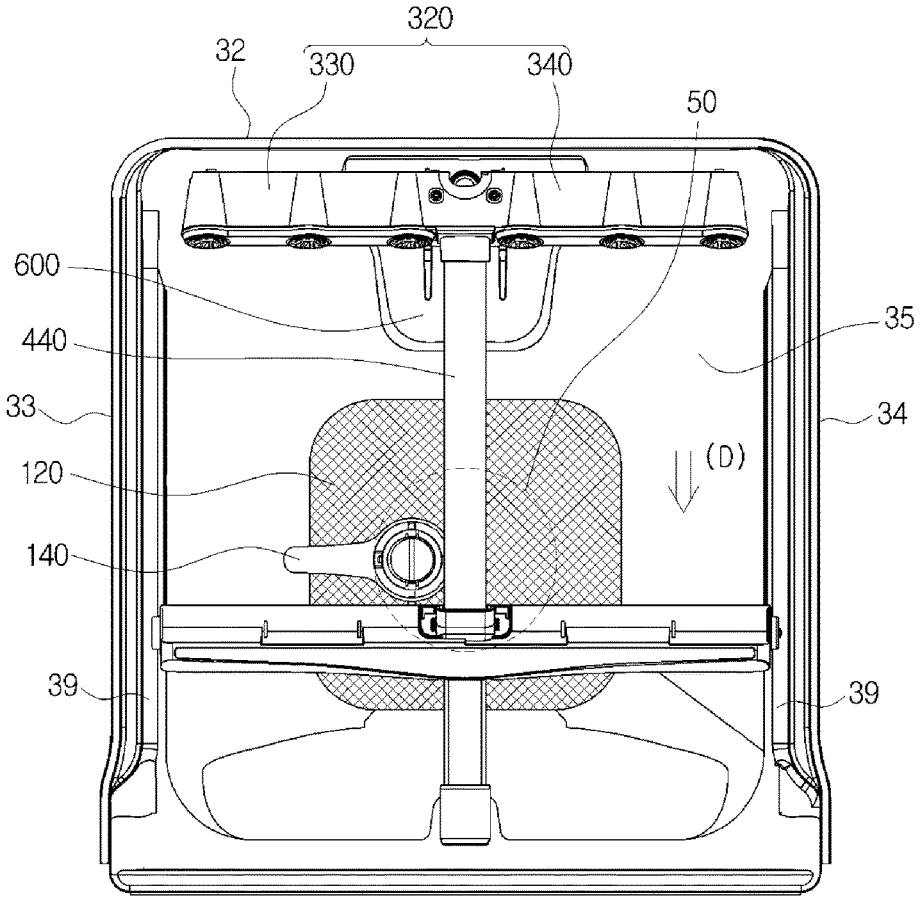
Figure 36:
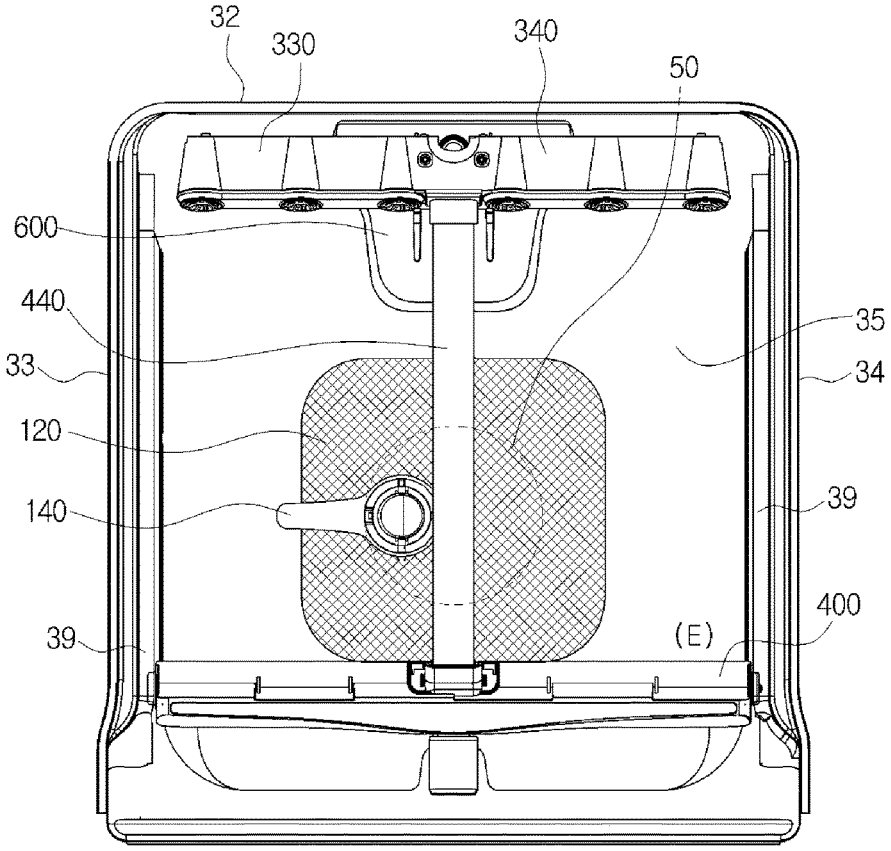

FIGS. 34 to 39 are views for describing a process of cleaning the reflecting module in a cleaning mode. When the user manipulates the cleaning mode selection button 23 as illustrated in FIG. 34 and the cleaning mode is selected (S30), the control unit 700 may generate a control command according to the cleaning mode and transmit the control command to the moving body driving unit 720. According to an embodiment, the control unit 700 may also generate a control command related to whether the door 11 is openable and closable. According to FIG. 35, in the cleaning mode, the reflecting module 400 may move in a direction in which the opening 11*a* is formed inside the wash tub 30 (S31). When the fixed nozzle assembly 320 is formed at the rear wall 32 that faces the opening 11*a* inside the wash tub 30, the reflecting module 400 may move in the opposite direction of a direction in which the fixed nozzle assembly 320 is installed (d). According to FIG. 36, the reflecting module 400 that has been moving toward the opening 11*a* may stop near the opening (e). In this way, movement and stoppage of the reflecting module 400 may be performed by operating the moving body driving unit 720 based on the control command of the control unit 700.

Figure 37:
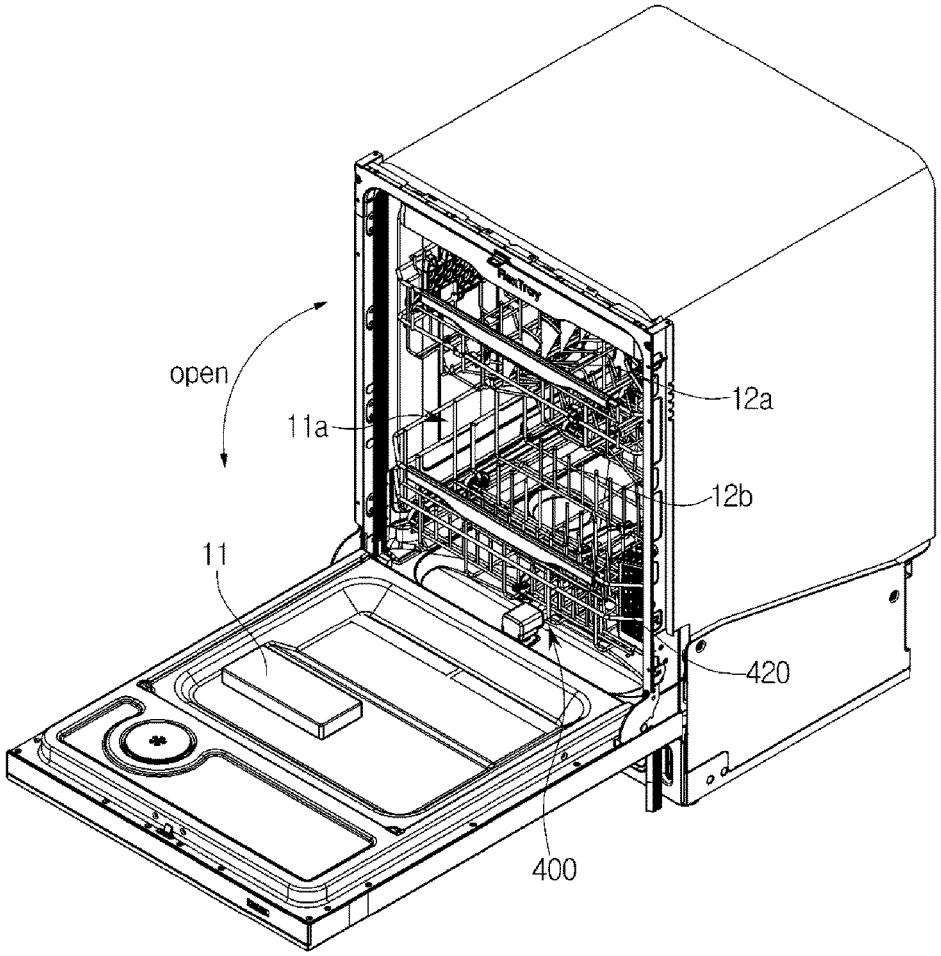

According to an embodiment, when the reflecting module 400 is stopped as illustrated in FIG. 37, the door 11 may be openable (S32). In other words, safety may be improved since the user can open the door 11 of the dishwasher 1 after the movement of the reflecting module 400 is finished to detach the reflecting module 400 from the moving body 490. Whether the door 11 is openable and closable may be determined according to a control signal transmitted from the control unit 700. Of course, step (S32) may also be omitted.

Figure 38:
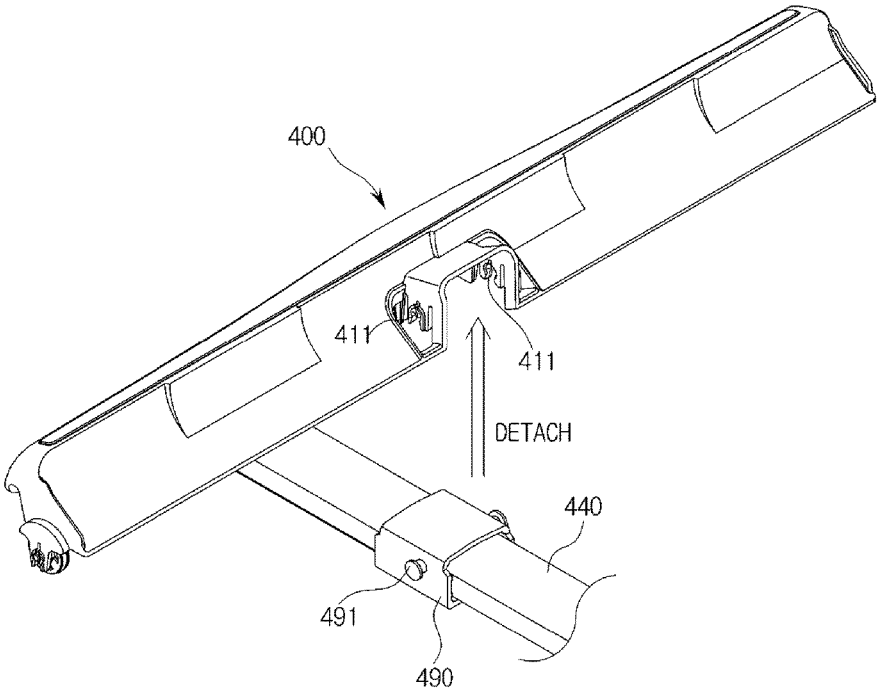

After the door 11 is open, the user may separate the first coupling member of the reflecting module 400 and the second coupling member of the moving body 490 from each other to detach the reflecting module 400 from the moving body 490. For example, as illustrated in FIG. 38, the user may separate the reflecting module 400 and the moving body 490 from each other by deviating the first coupling groove 411 of the reflecting module 400 from the first coupling protrusion unit 491 of the moving body 490 (S33).

Figure 39:
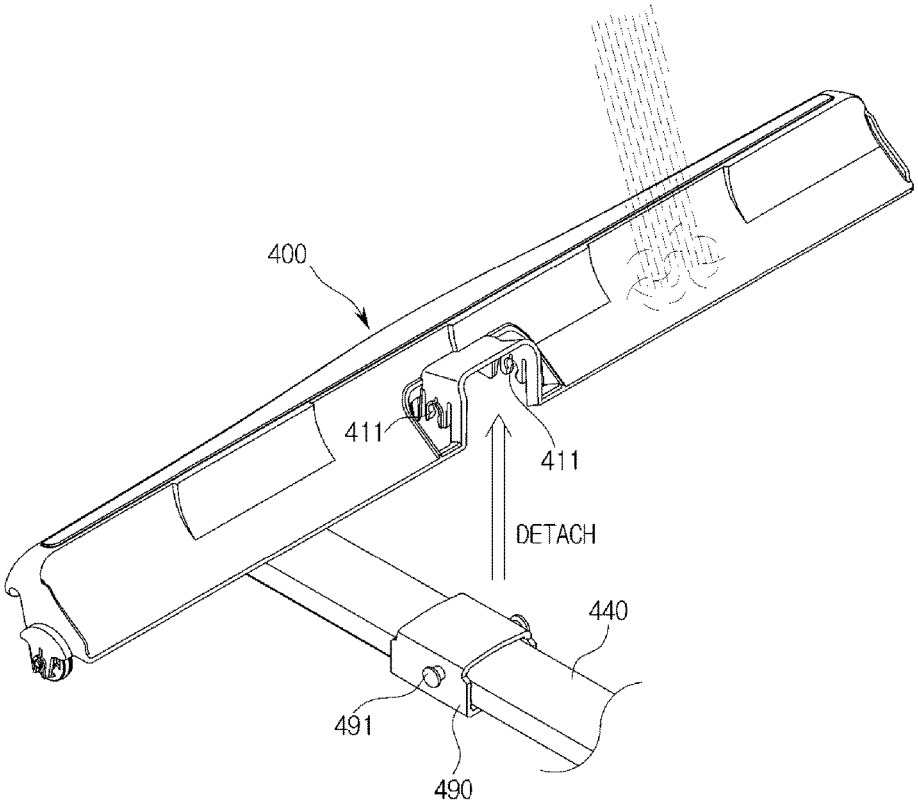

When the reflecting module 400 is separated, the user may wash and clean the reflecting module 400 using water and the like as illustrated in FIG. 39 (S34). When the cleaning of the reflecting module 400 is finished, the user may again couple the reflecting module 400 to the moving body 490 using the first coupling member of the reflecting module 400 and the second coupling member of the moving body 490 (S35). According to an embodiment, when the reflecting module 400 is coupled again to the moving body 490, a separate sensor (not shown) may detect whether the reflecting module 400 and the moving body 490 are coupled to each other. When the coupling between the reflecting module 400 and the moving body 490 is detected, the control unit 700 may generate a control command for moving the reflecting module 400 to the initial position as illustrated in FIG. 30 as needed, and the reflecting module 400 may move to the initial position (a) (S24).

The dishwasher and the method for controlling the same are industrially applicable due to being able to be used in households or industrial sites for washing dishes and the like.

The invention claimed is:

1. A dishwasher comprising:

a wash tub having an opening on at least one side thereof;

a spray nozzle provided inside the wash tub and configured to spray wash water;

a reflecting module movable inside the wash tub and configured to reflect the wash water sprayed by the spray nozzle;

a moving module to which the reflecting module is detachably coupled and configured to move the reflecting module in at least one direction; and a control unit configured to:

determine at least one control mode among a plurality of control modes for controlling the dishwasher, and control the reflecting module to move in a direction in which the opening is installed when the determined control mode is a cleaning mode of the reflecting module and stop the reflecting module near the opening, to increase accessibility of the reflecting module in the dishwasher for a user to detach the reflecting module from the moving module to clean the reflecting module.

2. The dishwasher of claim 1, wherein the moving module includes:

at least one rail; and a moving body configured to move along the at least one rail and to which the reflecting module is detachably coupled.

3. The dishwasher of claim 2, further comprising a fastening member configured to couple the reflecting module and the moving body to each other.

4. The dishwasher of claim 3, wherein the fastening member includes a pin or a bolt, and the pin or the bolt is insertable into and detachable from a coupling groove formed at each of the reflecting module and the moving body.

5. The dishwasher of claim 3, wherein the fastening member includes a first coupling member provided at the reflecting module and a second coupling member provided at the moving body and coupled to the first coupling member.

6. The dishwasher of claim 1, further comprising:

a motor configured to generate a driving force; and a belt configured to rotate by being connected to a drive pulley and an idle pulley to transmit the driving force of the motor to the moving module.

7. The dishwasher of claim 1, wherein the control unit is configured to stop the reflecting module when the reflecting module is near the opening.

8. The dishwasher of claim 7, wherein the control unit is configured to control a door provided at the opening to be openable and closable when the reflecting module is stopped, or to control the reflecting module to be detachable from the moving module when the reflecting module is stopped.

9. The dishwasher of claim 1, wherein the plurality of control modes include a dish washing mode, an operation standby mode, and the cleaning mode.

10. The dishwasher of claim 9, wherein the control unit is configured to control the reflecting module to move toward the spray nozzle when the determined control mode is the operation standby mode, or to control the spray nozzle to spray the wash water and the reflecting module to move inside the wash tub when the determined control mode is the dish washing mode.

11. The dishwasher of claim 1, wherein the spray nozzle is installed in a direction in which the opening is installed or an opposite direction from the direction in which the opening is installed inside the wash tub.

12. The dishwasher of claim 1, further comprising a main body with the wash tub built-therein.

13. The dishwasher of claim 12, further comprising an input unit provided outside the main body and configured to receive at least one selected command among a plurality of modes.

14. The dishwasher of claim 1, wherein the control unit is configured to control the reflecting module to move to an initial position when a coupling between the reflecting module and a moving body is detected.

15. A method for controlling a dishwasher that includes a wash tub in which an openable and closable opening is installed and a reflecting module provided inside the wash tub and movable in at least one direction, and is controlled according to at least one control mode among a plurality of control modes, the method comprising:

determining the at least one control mode among the plurality of control modes;

moving the reflecting module in a direction in which the opening of the wash tub is installed when the determined control mode is a cleaning mode of the reflecting module; and stopping the reflecting module when the reflecting module is near the opening, to increase accessibility of the reflecting module in the dishwasher for a user to clean the reflecting module.

16. The method of claim 15, further comprising:

controlling a door provided at the opening to be openable and closable when the reflecting module is stopped.

17. The method of claim 15, further comprising:

detaching the reflecting module from a moving module, wherein the moving module has the reflecting module detachably coupled thereto and moves the reflecting module in at least one direction.

18. The method of claim 15, wherein the plurality of modes includes a dish washing mode, an operation standby mode, and a cleaning mode.

19. The method of claim 18, further comprising:

reflecting wash water sprayed by a spray nozzle spraying the wash water by the reflecting module while the reflecting module moves when the determined mode is the dish washing mode; and moving the reflecting module toward a spray nozzle when the determined mode is an operation standby mode, wherein the spray nozzle is provided inside the wash tub and sprays the wash water onto the reflecting module.

20. The method of claim 15, wherein a moving module includes:

at least one rail; and a moving body configured to move along the at least one rail and to which the reflecting module is detachably coupled.

* * * * *